US008408100B2

(12) United States Patent
Liu

(10) Patent No.: US 8,408,100 B2
(45) Date of Patent: Apr. 2, 2013

(54) OPEN END WRENCH CAPABLE OF FAST DRIVING

(76) Inventor: Wen-Pin Liu, Taichung (TW)

( * ) Notice: Subject to any disclaimer, the term of this patent is extended or adjusted under 35 U.S.C. 154(b) by 322 days.

(21) Appl. No.: 12/881,243

(22) Filed: Sep. 14, 2010

(65) Prior Publication Data

US 2011/0197720 A1 Aug. 18, 2011

(30) Foreign Application Priority Data

Feb. 12, 2010 (TW) ..... 99104830 A

(51) Int. Cl.
*B25B 13/46* (2006.01)
*B25B 13/08* (2006.01)

(52) U.S. Cl. ..... 81/179

(58) Field of Classification Search ..... 81/179, 81/186, 60, 91.1, 91.2
See application file for complete search history.

(56) References Cited

U.S. PATENT DOCUMENTS

| | | | | |
|---|---|---|---|---|
| 365,019 | A | 6/1887 | Phillips | 81/179 |
| 385,595 | A | 7/1888 | Chappell | 81/179 |
| 1,320,668 | A | 11/1919 | Askman | 81/179 |
| 2,797,600 | A | 7/1957 | Beaver | 81/179 |
| 3,641,847 | A | 2/1972 | Horton | 81/111 |
| 3,695,125 | A | 10/1972 | Glass et al. | 81/179 |
| 4,158,975 | A | 6/1979 | DeSousa | 81/179 |
| 4,706,528 | A | 11/1987 | Inoue | 81/179 |
| 4,889,020 | A | 12/1989 | Baker | 81/119 |
| 5,287,777 | A | 2/1994 | Kolodziej | 81/179 |
| 5,533,428 | A * | 7/1996 | Pradelski | 81/179 |
| 7,024,971 | B2 | 4/2006 | Stanton | 81/179 |
| 7,111,529 | B2 | 9/2006 | Pradelski | 81/179 |
| 7,806,025 | B2 * | 10/2010 | Xinhong | 81/179 |
| 7,827,887 | B2 * | 11/2010 | Lee | 81/179 |
| 7,878,095 | B2 * | 2/2011 | Wu | 81/179 |
| 2008/0066585 | A1 | 3/2008 | Chiang | 81/125.1 |
| 2009/0044666 | A1 | 2/2009 | Xinhong | 81/92 |
| 2009/0193941 | A1 | 8/2009 | Chiu et al. | 81/165 |
| 2010/0071516 | A1 | 3/2010 | Wu | 81/176.1 |
| 2010/0083797 | A1 | 4/2010 | Lee | 81/60 |
| 2010/0147115 | A1 | 6/2010 | Lee | 81/60 |

* cited by examiner

*Primary Examiner* — David B Thomas
(74) *Attorney, Agent, or Firm* — Alan Kamrath; Kamrath IP Lawfirm, P.A.

(57) ABSTRACT

An open end wrench includes first and second jaws formed on a jaw portion. The first jaw includes an arcuate sliding groove having an arcuate sliding wall. A slide is received in the sliding groove and includes an arcuate sliding face slideable along the sliding wall. An arcuate guiding slot is formed in the slide. The sliding face, sliding wall and guiding slot are free of holes, grooves, and recesses. A guide is fixed in the sliding groove and received in the guiding slot. The guiding slot includes an abutting end and a pressing end. The abutting end is in contact with the guide when the slide is in an initial position not engaged with a workpiece. An elastic device has two ends respectively abutting the guide and the pressing end of the guiding slot for biasing the slide to the initial position.

18 Claims, 27 Drawing Sheets

OPEN END WRENCH CAPABLE OF FAST DRIVING

BACKGROUND OF THE INVENTION

The present invention relates to an open end wrench capable of fast driving and, more particularly, to an open end wrench capable of fast driving a workpiece without the risk of undesired shifting from the workpiece.

U.S. Pat. No. 1,320,668 discloses a wrench including a stationary jaw and a movable jaw slideable along a guide. The movable jaw is forced against an abutment at an outer end of the guide by a spring bearing against the stationary jaw. An end of the spring is received in a bore in the stationary jaw. The other end of the spring is received in another bore in the movable jaw. An intermediate portion of the spring is exposed between the stationary jaw and the movable jaw. When the user intends to tighten or loosen a nut, the wrench is turned in a driving direction during which operation the movable jaw remains in contact with the abutment. For reengagement of the wrench with the nut, it is necessary only to turn the wrench in the opposite direction, during which operation the movable jaw slides backward against the pressure of the spring and on the edges of the nut. The movable jaw is forced forward again as soon as the bearing surfaces of the stationary and movable jaws are parallel with the sides of the nut. The nut can be tightened or loosened through repeated operations. However, the movable jaw wobbles, because the spring can not maintain the position of the movable jaw in a direction transverse to the sliding direction. Furthermore, the movable jaw is liable to disengage from the guide due to impact or falling to the ground. The spring will disengage from the wrench after disengagement of the movable jaw. Further, the exposed portion of the spring, when compressed by the movable jaw, is liable to bend and, thus, is in friction contact with the end edges of the bores of the stationary and movable jaws, leading to a non-smooth compression of the spring or even permanent deformation of the spring. Further, the exposed portion of the spring is apt to be contaminated by oil to which debris easily adheres, hindering movement of the movable jaw.

U.S. Pat. No. 3,695,125 discloses an open end ratchet wrench including a head having a fixed jaw and an opposed pawl support portion. A pawl and a spring are mounted to an inner side of the pawl support portion. The pawl is biased by the spring and slideable between an extended torquing position and a retracted ratcheting position. Two side caps are fixed to two sides of the head to define a space receiving the pawl and the spring and to prevent disengagement of the pawl and the spring. The pawl includes a stop shoulder to prevent the pawl from moving out of the pawl support portion under the action of the spring. However, the side caps may separate from the head when the wrench falls to the ground, causing disengagement of the pawl from the pawl support portion and subsequent failing of the spring. Furthermore, the pawl merely biased by the spring is still liable to wobble, although there are two side caps on opposite sides of the pawl. Further, the spring is liable to shift from its original position due to impingement to or repeated compression of an exposed portion of the spring, causing malfunction of the spring. Further, a gap exists between the side caps and the pawl when the pawl is moved into the space. Oil and debris may enter the gap and adversely affect the compression of the spring and the movement of the pawl.

U.S. Pat. No. 4,706,528 discloses an adjustable wrench including a fixed jaw and an adjustable jaw. In an embodiment, a sliding jaw portion is provided on the fixed jaw. The sliding jaw includes a rectilinearly extending slot through which a pin is extended, preventing disengagement of the sliding jaw. A plate spring is mounted to an inner face of the fixed jaw to bias the sliding jaw outward. A hole is formed in an end wall of the slot and receives a coil spring to bias the sliding jaw inward. Thus, the sliding jaw is movable inward or outward and can be retained in place under action of the plate spring and the coil spring. Such a wrench is particularly suitable for rotating pipes, but not suitable for tightening or loosening fasteners such as bolts, nuts, or the like. Specifically, since a pipe has no plane surfaces and is, thus, difficult to grip, the sliding jaw is moved outward to shorten the distance between the sliding jaw and the adjustable jaw for firmly clamping the pipe to permit tightening or loosening of the pipe. The sliding jaw is returned by moving inward under the action of the coil spring. Furthermore, the pipe causes inward movement of the sliding jaw and will not rotate when the wrench is rotated in a reverse direction. However, the coil spring is redundant when the wrench is utilized on a nut or bolt head that has flat sides. In the case that the wrench drives a nut or bolt head having flat faces in a reverse direction, the nut or bolt head initially permits the sliding jaw to move inward. However, when the jaw moves inward to its innermost position, the spacing between the sliding jaw and the adjustable jaw is still smaller than the spacing between two corners of the nut or bolt head such that the nut or bolt head will be rotated in the reverse direction, which is undesired. This is because the sliding jaw moves rectilinearly along the rectilinearly extending slot along an axis at a relatively small angle to a plane on which the adjusting jaw lies. Further, formation of a hole in the inner face of the fixed jaw for receiving a small screw to position the plate spring and formation of the hole for receiving the coil spring reduce the structural strength of the wrench such that the wrench can only be utilized for pipes that are hollow and, thus, exert smaller reactive force (which avoids deformation of the hollow pipes) when the pipes are rotated by the wrench. Further, although the coil spring has an end received in the hole of the sliding jaw, the other end of the coil spring outside of the hole is liable to bend when the spring is compressed, leading to friction at the end edge of the opening of the hole and resulting in non-smooth compression of the spring or even permanent deformation of the spring. Further, the slot is open such that most of the reactive force imparted to the sliding jaw during driving of a pipe or nut is transmitted to and, thus, damages the pin. This is because although the sliding jaw has a plane face in sliding contact with another plane face of the fixed jaw, the plane face of the sliding jaw can not provide guidance for the inward or outward movement of the sliding jaw. As a result, the plane face of the sliding jaw transmits the reactive force to the pin instead of effectively withstanding the torque.

U.S. Pat. No. 7,024,971 discloses an open end ratchet wrench including first and second stationary jaws. The first stationary jaw supports a movable plate. A space is sandwiched between two face plates of the first stationary jaw to accommodate the movable plate. The movable plate includes two angled slots each receiving a pin extending through the space, avoiding disengagement of the movable plate. The wrench further includes a hole receiving a spring that has an end located outside of the hole for biasing the movable plate. Each angled slot of the movable plate includes a short section and a long section at an angle to the short section such that the movable plate can move in two stages each having a rectilinear travel. Although the two-stage movement of the movable plate increases the spacing between the movable plate and the second stationary jaw, the movable plate is liable to get stuck at the intersection of the long and short sections, adversely affecting operation of the wrench in the reverse direction. Furthermore, the spring has an exposed section that is liable to bend when the spring is compressed, leading to friction at the end edge of the opening of the hole and resulting in non-smooth compression of the spring or even permanent deformation of the spring. Further, the angled slots increase the area of the movable plate or the first stationary jaw, resulting in difficulties in reducing the volume of the open end wrench. Thus, the wrench can not be used in a small space. If the area of the movable plate is increased or the first stationary jaw is reduced in size, the short section or the longer section would be exposed outside of the first stationary jaw such that debris is apt to accumulate in the slots, adversely affecting rectilinear movement of the movable plate. Further, since the space is open in both sides, the reaction force imparted to the movable plate during driving of a workpiece is completely transmitted to the pins that can not withstand high torque. As a result, the wrench can not be used in a high-torque driving operation.

U.S. Publication No. 2009/0193941 A1 discloses first and second jaws formed on a jaw support. The first jaw can be moved by rotating a worm. The jaw support includes an open track in the form of a slot receiving the second jaw. The jaw support further includes a pin extending through the track. The second jaw includes a rectilinear opening through which the pin extends, preventing the second jaw from disengaging from the jaw support. A biasing member is mounted in the opening of the second jaw to bias the second jaw outward. Since the second jaw includes a single rectilinear opening, a change in the spacing from the second jaw to the first jaw is relatively small such that a workpiece will be rotated when the wrench rotates in a reverse direction not intended to rotate the workpiece. Thus, the first jaw must be movable, and the spacing between the first and second jaws can be adjusted by rotating the worm to avoid joint rotation of the workpiece when the wrench rotates in the reverse direction. However, the wrench of this type includes many elements, and the track, opening, and holes in the elements weaken the wrench. Furthermore, since the track is open, the reaction force imparted to the second jaw during driving of the workpiece is completely transmitted to the pin. Thus, the pin is liable to be damaged. Although the second jaw includes a surface in sliding contact with the jaw support to guide sliding movement of the second jaw, this surface merely transmits the reactive force to the pin instead of effectively withstanding the torque. Further, since the second jaw moves rectilinearly, the opening in the second jaw must be lengthened if it is desired to increase the spacing between the first and second jaws. However, this would expose the opening support such that the opening and the biasing member in the opening would easily be contaminated by oil to which debris adheres easily. Furthermore, operation of the biasing member would be adversely affected, causing non-smooth movement of the second jaw.

Thus, a need exists for an open end wrench capable of fast driving of a workpiece without the disadvantages of the above conventional open end wrenches.

BRIEF SUMMARY OF THE INVENTION

The present invention solves this need and other problems in the field of reliable structural strength of fast drivable open end wrenches by providing, in a preferred form, an open end wrench capable of fast driving a workpiece. The workpiece includes first, second, third, fourth, fifth, and sixth sides respectively having first, second, third, fourth, fifth, and sixth force-receiving faces in a first rotating direction and respectively having first, second, third, fourth, fifth, and sixth force-receiving faces in a second rotating direction. The open end wrench includes a body having a handle and a jaw portion formed on an end of the handle. Spaced first and second jaws are formed on an end of the jaw portion opposite to the handle. The jaw portion includes a throat intermediate the first and second jaws. The throat and the first and second jaws together define a wrenching space adapted for receiving the workpiece. The jaw portion includes a force-applying face facing the wrenching space and facing a distal end of the second jaw. The force-applying face is adapted to correspond to the first force-receiving face in the first rotating direction of the workpiece. The first jaw further includes an arcuate sliding groove facing the wrenching space. The sliding groove includes spaced, first and second support walls and an arcuate sliding wall extending between the first and second support walls. The sliding wall is free of holes, grooves, and recesses and has an arcuate face. A guide is provided in the sliding groove and has two ends fixed to the first and second support walls. A slide is slideably received in the sliding groove. The slide includes a first side having an arcuate sliding face slideable along the sliding wall of the sliding groove. The sliding face is free of holes, grooves, and recesses. The slide further includes a second side opposite to the first side of the slide. The second side of the slide includes a first wrenching face located outside of the sliding groove. The first wrenching face is adapted to correspond to the fourth force-receiving face in the first rotating direction of the workpiece. The slide further includes a top face and a bottom face. The slide further includes an arcuate guiding slot extending from the top face through the bottom face. The guiding slot is free of holes, grooves, and recesses. The guide is received in the guiding slot, preventing the slide from disengaging from the sliding groove. The guiding slot includes an abutting end and a pressing end. The abutting end is in contact with the guide when the slide is in an initial position not engaged with the workpiece. An elastic device has two ends respectively abutting the guide and the pressing end of the guiding slot for biasing the slide to the initial position.

Since the sliding wall of the sliding groove is free of holes, grooves, and recesses, the structural strength of the first and second jaws is enhanced such that the jaw portion can withstand high-torque operation. Since the sliding face and the guiding slot of the slide are free of holes, grooves, and recesses, the processing costs of the slide can be effectively reduced while providing the open end wrench with high torque bearing capacity and allowing the open end wrench to be manufactured at low costs.

In preferred forms, the slide includes a second wrenching face at an angle of 120° to the first wrenching face. The second wrenching face is adapted to correspond to the third force-receiving face in the first rotating direction of the workpiece. The slide further includes an evasive portion between the first and second wrenching faces. The evasive portion of the slide is adapted to allow entrance of the third force-receiving face in the second rotating direction of the workpiece.

In preferred forms, the sliding face of the slide has a curvature equal to that of the sliding wall of the sliding groove. The sliding face of the slide is smoothly slideable along the sliding wall of the sliding groove. The sliding face is adapted to transmit reactive force from the workpiece to the sliding wall and to avoid concentration of stress on the slide, increasing torque bearing capacity of the slide when the workpiece is driven by the body to rotate. The guiding slot has a curvature equal to that of the sliding wall of the sliding groove, allowing relative smooth, arcuate sliding between the guiding groove of the slide and the guide in the sliding groove without operational interference therebetween.

In preferred forms shown, the first and second jaws and the jaw portion are integrally formed as a single and inseparable component of the same material to increase the structural strength and the torque bearing capacity of the jaw portion.

In preferred forms shown, the throat includes a push face facing the wrenching space. The push face is at an angle of 120° to the force-applying face of the first jaw. The push face of the throat is adapted to correspond to the second force-receiving face in the first rotating direction of the workpiece. The second jaw includes first and second faces at an angle of 120° to each other. The first and second faces are adapted to correspond respectively to the fourth and third force-receiving faces in the first rotating direction of the workpiece. A first evasive portion is formed between the force-applying face of the first jaw and the push face of the throat. The first evasive portion is adapted to allow entrance of the first force-receiving face in the second rotating direction of the workpiece. A second evasive portion is formed between the push face of the throat and the second face of the second jaw. The first evasive portion is adapted to allow entrance of the second force-receiving face in the second rotating direction of the workpiece. The jaw portion further includes a third evasive portion between the first and second faces of the second jaw. The third evasive portion is adapted to allow entrance of the third force-receiving face in the second rotating direction of the workpiece.

In preferred forms shown, the elastic device includes an elastic element received in the guiding slot of the slide. The first and second support walls of the sliding groove are parallel to each other and have a spacing therebetween. The top and bottom faces of the slide are parallel to each other and have a height in a height direction of the slide equal to the spacing. The guiding slot of the slide has a height in the height direction of the slide equal to the height of the slide. The guiding slot has a width in a width direction perpendicular to the height direction of the guiding slot. The width of the guiding slot is equal to a diameter of the guide. The height of the guiding slot is larger than 1.5 times the width of the guiding slot. The elastic element received in the guiding slot has a height in the height direction of the slide not larger than the height of the guiding slot. The height of the elastic element is larger than the width of the guiding slot. The height of the elastic element is larger than 0.5 times the height of the guiding slot.

In other preferred forms, the elastic device includes a base and two elastic elements mounted to a side of the base. The first and second support walls of the sliding groove are parallel to each other and have a spacing therebetween. The top and bottom faces of the slide are parallel to each other and have a height in a height direction of the slide equal to the spacing. The guiding slot of the slide has a height in the height direction of the slide equal to the height of the slide. The guiding slot has a width in a width direction perpendicular to the height direction of the guiding slot. The width of the guiding slot is equal to a diameter of the guide. The height of the guiding slot is larger than 1.5 times the width of the guiding slot. The elastic elements are spaced in the height direction of the slide. The elastic elements attached to the base have an overall height in the height direction of the slide not larger than the height of the guiding slot. The overall height of the elastic elements is larger than the width of the guiding slot. The overall height of the elastic elements is larger than 0.5 times the height of the guiding slot.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
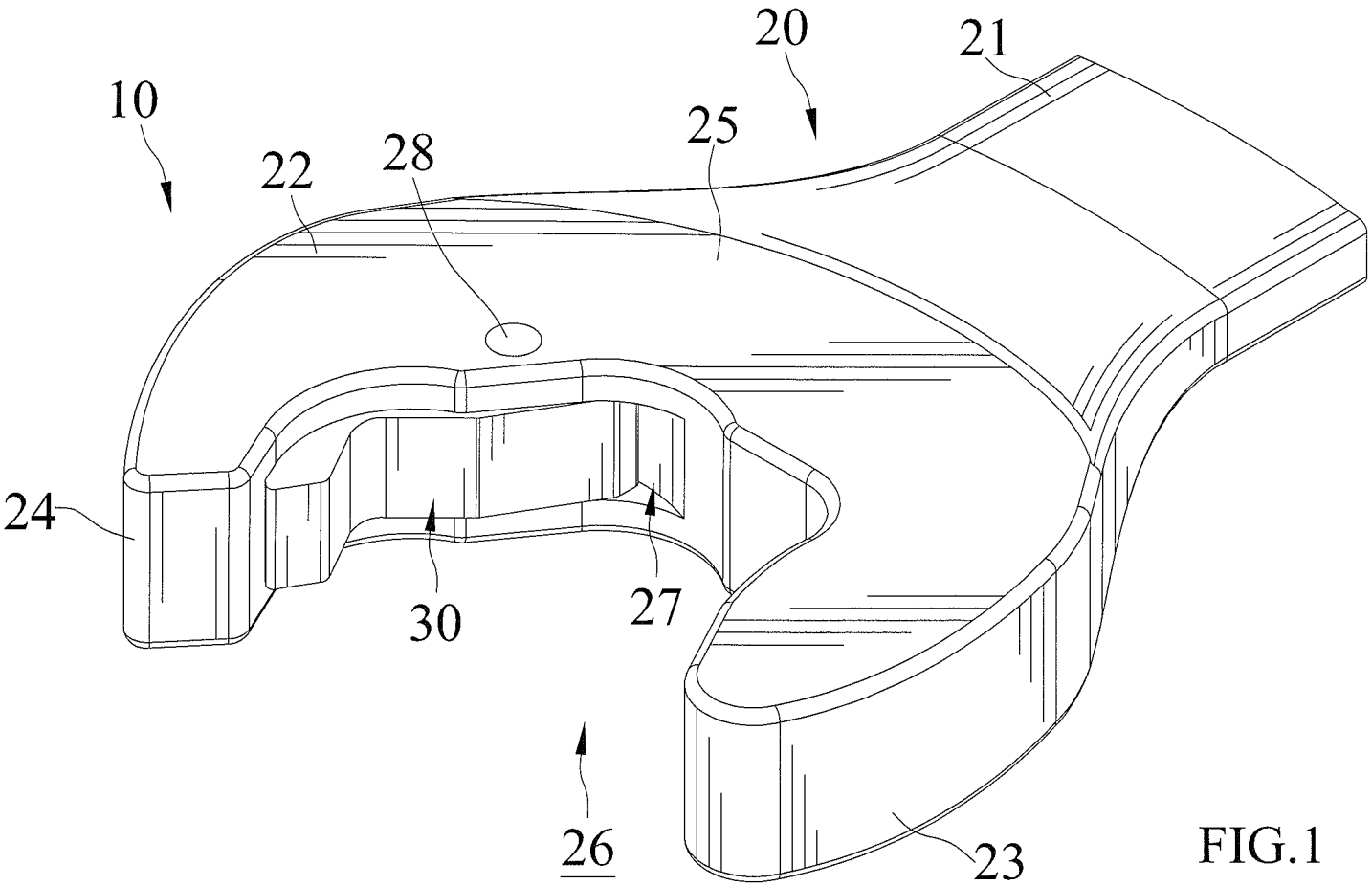
FIG. 1 shows a partial, perspective view of an open end wrench of a first embodiment according to the preferred teachings of the present invention.
Figure 2:
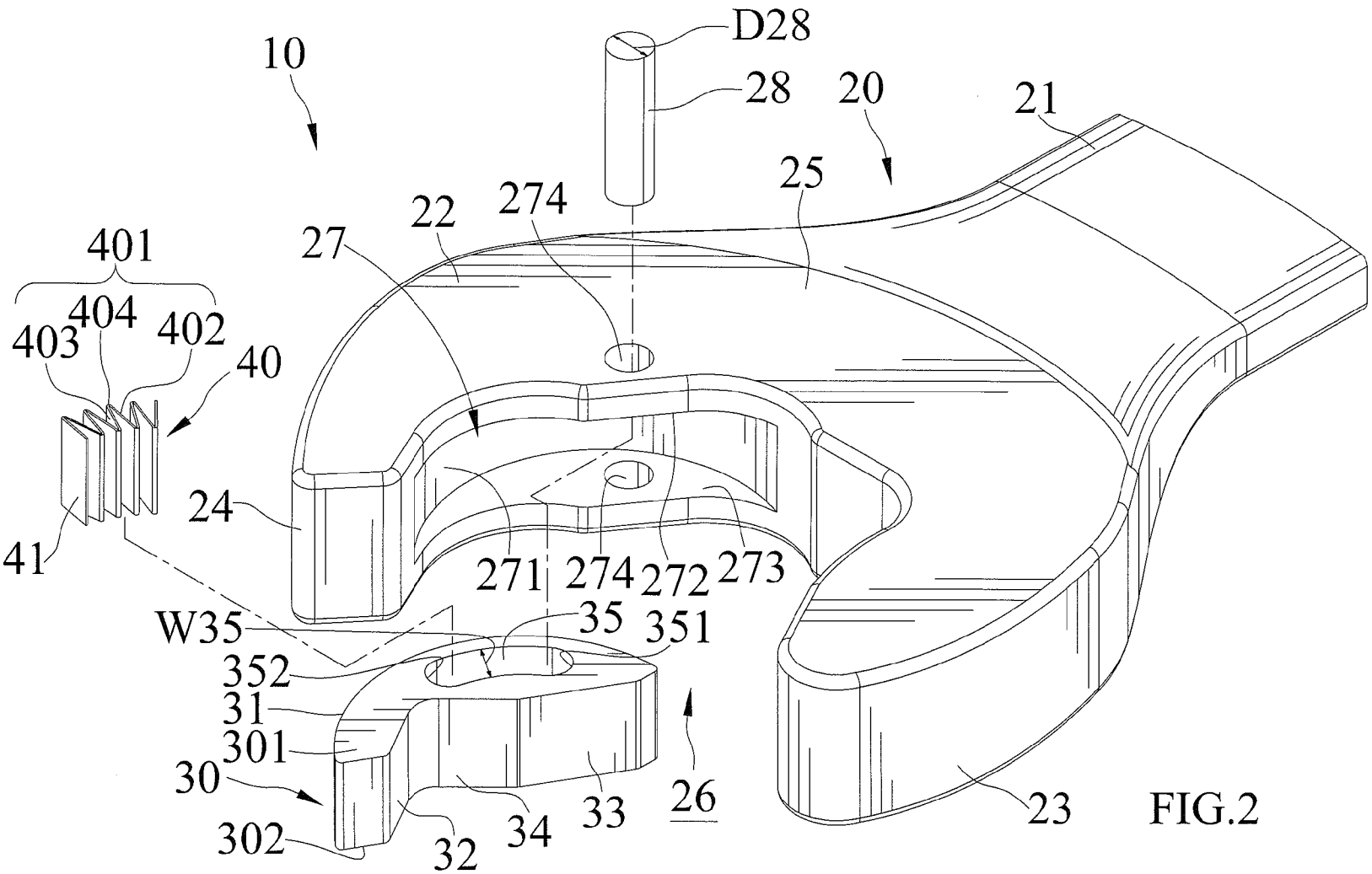
FIG. 2 shows a partial, exploded, perspective view of the open end wrench of FIG. 1.
Figure 3:
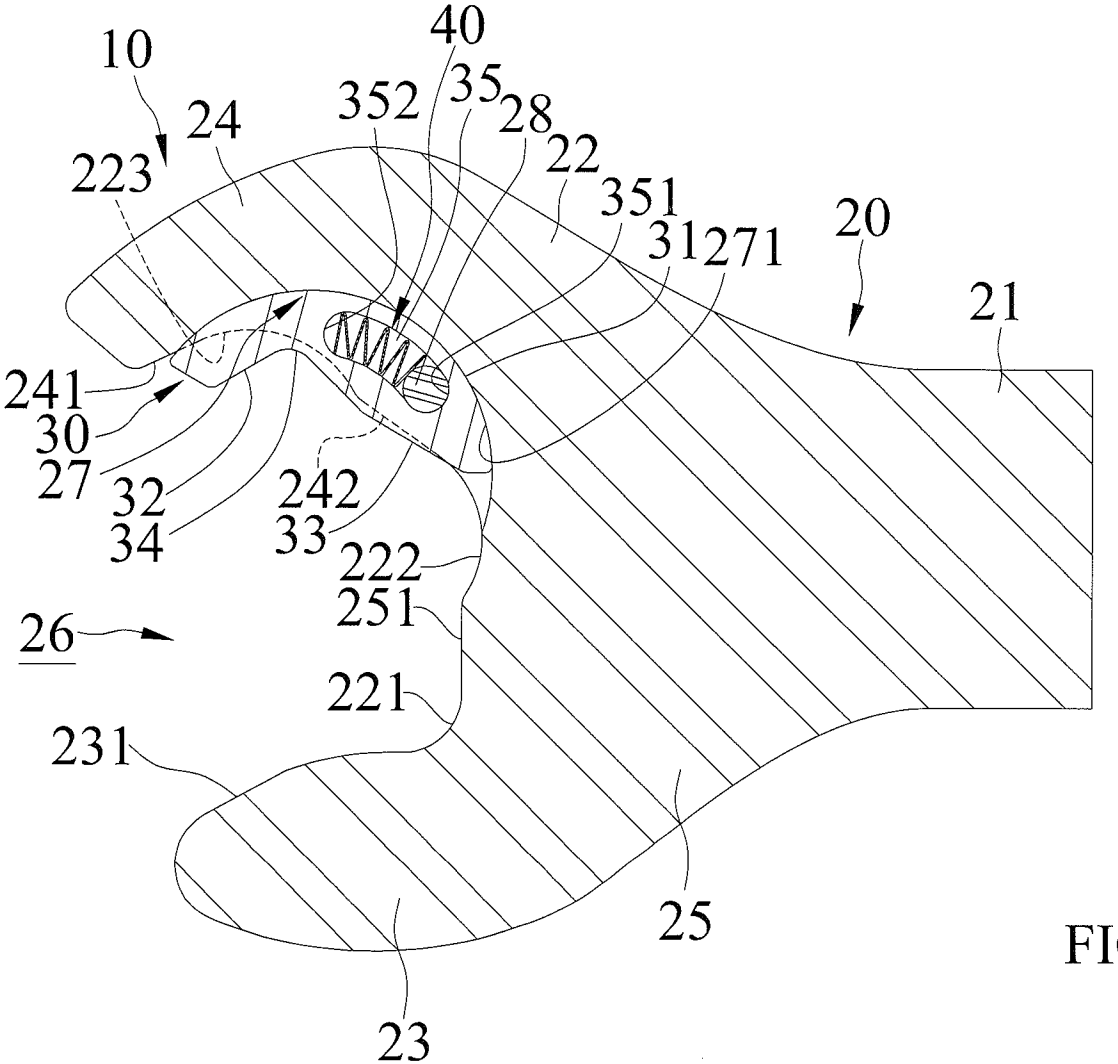
FIG. 3 shows a partial, cross sectional view of the open end wrench of FIG. 1.
Figure 4:
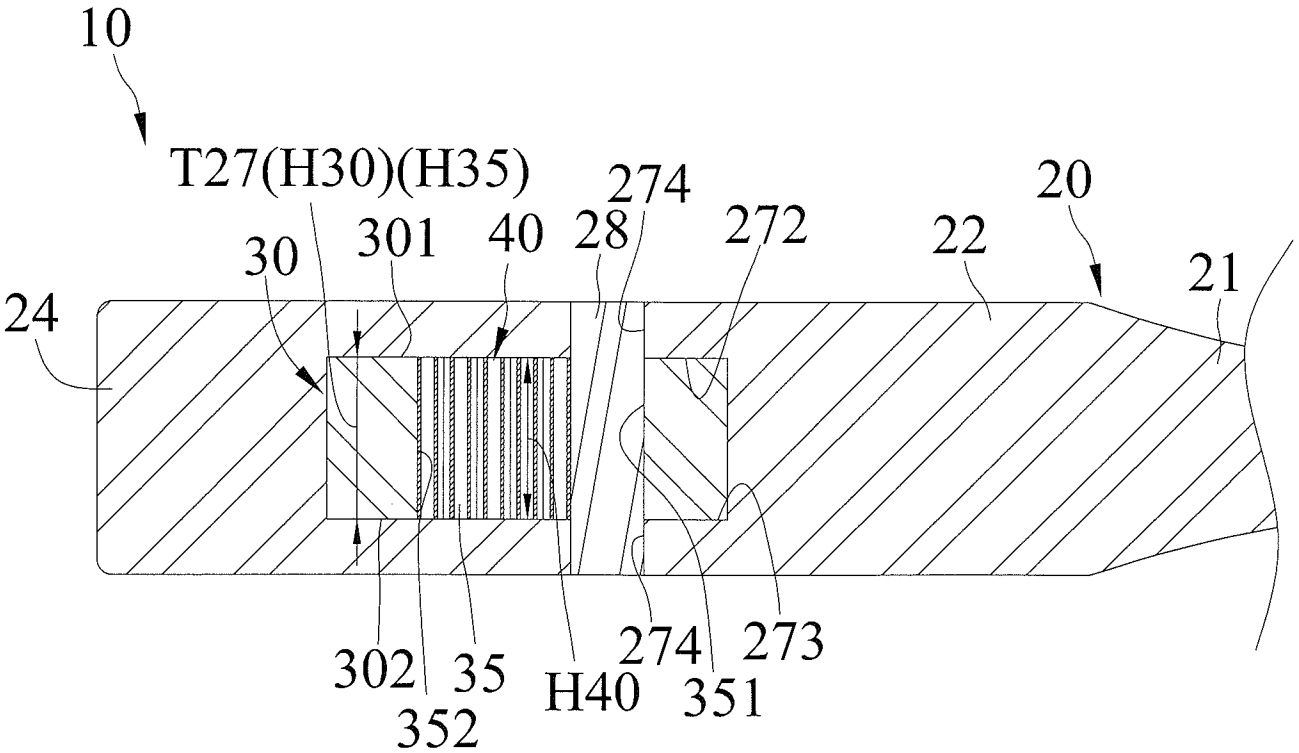
FIG. 4 shows another partial, cross sectional view of the open end wrench of FIG. 1.

All figures are drawn for ease of explanation of the basic teachings of the present invention only; the extensions of the figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "third", "fourth", "fifth", "sixth", "lower", "upper", "inner", "outer", "side", "end", "portion", "section", "spacing", "clockwise", "counterclockwise", "width", "height", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

FIGS. 1-11 show an open end wrench 10 of a first embodiment according to the preferred teachings of the present invention. Open end wrench 10 includes a body 20, a slide 30, and an elastic device 40.

Body 20 includes a handle 21 and a jaw portion 22 formed on an end of handle 21. Jaw portion 22 can hold a workpiece 90, such as a hexagonal head of a bolt, a nut, or the like. Workpiece 90 includes first, second, third, fourth, fifth, and sixth sides respectively having first, second, third, fourth, fifth, and sixth force-receiving faces in a first rotating direction 91A, 92A, 93A, 94A, 95A, and 96A. The first, second, third, fourth, fifth, and sixth sides of workpiece 90 respectively have first, second, third, fourth, fifth, and sixth force-receiving faces in a second rotating direction 91B, 92B, 93B, 94B, 95B, and 96B. A user can grip the handle 21 and rotate body 20 as well as jaw portion 22 about an axis of workpiece 90 to tighten or loosen workpiece 90.

Spaced first and second jaws 23 and 24 are formed on an end of jaw portion 22 opposite to handle 21. First and second jaws 23 and 24 can withstand reactive force from workpiece 90. First and second jaws 23 and 24 face each other. Furthermore, first and second jaws 23 and 24 and jaw portion 22 are integrally formed as a single and inseparable component of the same material to provide jaw portion 22 with excellent structural strength and to increase the torque bearing capacity of jaw portion 22.

Jaw portion 22 further includes a throat 25 intermediate first and second jaws 23 and 24. Throat 25 and first and second jaws 23 and 24 together define a wrenching space 26. Jaw portion 22 can enter wrenching space 26 by moving jaw portion 22 in a direction perpendicular to one of the six sides of workpiece 90 or by moving jaw portion 22 along the axis of workpiece 90.

First jaw 23 includes a force-applying face 231 facing wrenching space 26 and facing a distal end of second jaw 24. Force-applying face 231 corresponds to first force-receiving face in the first rotating direction 91A of workpiece 90. Second jaw 24 includes first and second faces 241 and 242. First face 241 faces wrenching space 26 and throat 25. Second face 242 faces wrenching space 26 and a distal end of first jaw 23. First face 241 is at an angle of 120° to second face 242 such that first and second faces 241 and 242 correspond respectively to fourth and third force-receiving faces in the first rotating direction 94A and 93A. First face 241 of second jaw 24 is substantially parallel to force-applying face 231 of first jaw 23.

Throat 25 includes a push face 251 facing wrenching space 26. Push face 251 is at an angle of 120° to force-applying face 231 of first jaw 23 such that push face 251 corresponds to second force-receiving face in the first rotating direction 92A. Second face 242 is intermediate first face 241 and push face 251.

Jaw portion 22 further includes a first evasive portion 221 between force-applying face 231 of first jaw 23 and push face 251 of throat 25. First evasive portion 221 can receive first force-receiving face in the second rotating direction 91B of workpiece 90. Jaw portion 22 further includes a second evasive portion 222 between push face 251 of throat 25 and second face 242 of second jaw 24. Second evasive portion 222 can receive second force-receiving face in the second rotating direction 92B of workpiece 90. Furthermore, jaw portion 22 includes a third evasive portion 223 between first and second faces 241 and 242 of the second jaw 24. Third evasive portion 223 can receive third force-receiving face in the second rotating direction 93B of workpiece 90.

An arcuate sliding groove 27 is formed in second jaw 24 and faces wrenching space 26. Sliding groove 27 includes spaced, first and second support walls 272 and 273 and a concave, arcuate sliding wall 271 extending between first and second support walls 272 and 273. Sliding wall 271 is free of holes, grooves, recesses, etc., providing a complete arcuate surface and enhancing the structural strength of second jaw 24. Thus, jaw portion 22 can withstand high-torque operation. Furthermore, a center of an arcuate face of the sliding wall 271 is located in wrenching space 26 such that sliding wall 271 can be easily and rapidly processed with a single cutter at low costs while assuring structural strength of jaw portion 22. First and second support walls 272 and 273 are parallel to each other and have a spacing T27 therebetween.

A circular through-hole 274 is extended through first and second support walls 272 and 273 and in communication with sliding groove 27. Through-hole 274 is located adjacent to throat 25 and receives a cylindrical guide 28 in the form of a pin. Two ends of guide 28 are received in two ends of through-hole 274 in first and second support walls 272 and 273 to retain guide 28 in sliding groove 27. Guide 28 has a diameter D28.

Slide 30 is slideably received in sliding groove 27 and can drive workpiece 90 to rotate in a driving direction or slide along a perimeter of workpiece 90 in an opposite direction opposite to the driving direction without driving workpiece 90. Slide 30 is substantially arcuate in cross section and includes a side having a convex, arcuate sliding face 31 slideably abutting sliding wall 271 of sliding groove 27, allowing relative arcuate sliding movement between slide 30 and jaw portion 22. Sliding face 31 is free of holes, grooves, recesses, etc., providing a complete arcuate surface and enhancing the structural strength of slide 30. Thus, slide 30 can withstand high-torque operation.

Sliding face 31 of slide 30 has a curvature the same as that of sliding wall 271 of sliding groove 27 to allow smooth sliding of sliding face 31 on sliding wall 271. Furthermore, when slide 30 is subjected to a reactive force from workpiece 90, the reactive force from the workpiece 90 can be transmitted to sliding wall 271 through a large area of sliding face 31 due to the same curvature. Thus, the force imparted to slide 30 can be distributed, avoiding stress concentration and increasing the torque bearing capacity of slide 30 when workpiece 90 is driven by body 20.

The other side of slide 30 opposite to sliding face 31 is located outside of sliding groove 27 and includes first and second wrenching faces 32 and 33. First and second wrenching faces 32 and 33 are adapted to drive workpiece 90 to rotate. First wrenching face 32 is at an angle of 120° to second wrenching face 33 such that first and second wrenching faces 32 and 33 correspond respectively to fourth and third force-receiving faces in the first rotating direction 94A and 93A of workpiece 90. An evasive portion 34 is formed between first and second wrenching faces 32 and 33 and can receive third force-receiving face in the second rotating direction 93B of workpiece 90.

Slide 30 further includes a top face 301 and a bottom face 302 respectively at upper and lower sides thereof. First and second wrenching faces 32 and 33 extend between top and bottom faces 301 and 302. Top and bottom faces 301 and 302 are parallel to each other and are respectively in contact with first and second support walls 272 and 273 of sliding groove 27. Slide 30 has a height H30 between top and bottom faces 301 and 302 in a height direction. Ignoring the tolerance, height H30 of slide 30 is the same as spacing T27 of sliding groove 27. This allows top and bottom faces 301 and 302 of slide 30 to be symmetrically supported by first and second support walls 272 and 273 of sliding groove 27, avoiding wobbling of slide 30 while sliding in sliding groove 27 along an arcuate path and increasing operational stability of open end wrench 10.

Slide 30 further includes a guiding slot 35 extending from top face 301 through bottom face 302. Guiding slot 35 is arcuate in cross section and has two opposite lateral sides each curved with a curvature the same as the curvature of sliding wall 271 of sliding groove 27. Since guiding slot 35 extends from top face 301 through bottom face 302, a height H35 of guiding slot 35 in the height direction of slide 30 is the same as height H30 of slide 30. Furthermore, guiding slot 35 has a width W35 (between inner and outer arcuate surfaces thereof) in a width direction perpendicular to the height direction of slide 30. Namely, width W35 is equal to a difference between a radius of the outer arcuate surface and a radius of the inner arcuate surface of guiding slot 35. Ignoring the tolerance, width W35 of guiding slot 35 is the same as diameter D28 of guide 28. Height H35 of guiding slot 35 is larger than 1.5 times width W35 of guiding slot 35 (i.e., width W35 of guiding slot 35 is smaller than 0.66 times height H35 of guiding slot 35. In this embodiment, height H35 of guiding slot 35 is larger than two times width W35 of guiding slot 35 (i.e., width W35 of guiding slot 35 is smaller than 0.5 times height H35 of guiding slot 35).

Guiding slot 35 receives guide 28 to prevent slide 30 from disengaging from sliding groove 27. Since the curvature of sliding face 31 of slide 30 is the same as those of guiding slot 35 and sliding wall 271 of sliding groove 27, smooth sliding movement between guiding slot 35 of slide 30 and guide 28 in sliding groove 27 can be obtained while sliding face 31 of slide 30 is moving along sliding wall 271 of sliding groove 27 along the arcuate path. Undesired interference between slide 30, guide 28, and sliding wall 271 is avoided.

Guiding slot 35 further includes an abutting end 351 and a pressing end 352. When slide 30 is in a natural, initial position not in contact with workpiece 90, abutting end 351 is in contact with guide 28, and pressing end 352 is in contact with elastic device 40. Since all of the surfaces of guiding slot 35 are free of holes, grooves, recesses, etc., stress concentration is avoided, and the structural strength of slide 30 is assured. Thus, slide 30 can withstand high-torque operation. Furthermore, since sliding face 31 and all of the surfaces of guiding slot 35 of slide 30 are free of holes, grooves, recesses, etc., the manufacturing costs of slide 30 can be reduced while providing open end wrench 10 with high-torque capacity and allowing open end wrench 10 to be produced at low costs for wider industrial application.

Elastic device 40 has two ends respectively abutting guide 28 and pressing end 352 of guiding slot 35 for returning slide 30 to its natural, initial position. Elastic device 40 includes an elastic element 41 mounted in guiding slot 35 of slide 30. After mounting, elastic element 41 is completely received in guiding slot 35. Elastic element 41 has a height 1140 in the height direction of slide 30 not larger than height 1135 but larger than width W35 of guiding slot 35. Furthermore, height H40 of elastic element 41 is larger than 0.5 times height 1135 of guiding slot 35. Thus, rotation of elastic element 41 in guiding slot 35 is avoided, preventing slide 30 from shifting from its natural, initial position after returning.

In this embodiment, elastic element 41 is a resilient plate having Z-shaped cross sections. At least one force-storing unit 401 is provided between two ends of elastic element 41. Each force-storing unit 401 is in the form of a metal plate having substantially V-shaped cross sections. Each force-storing unit 401 includes first and second legs 402 and 403 and a compression section 404 between first and second legs 402 and 403. Compression section 404 can store energy when first and second legs 402 and 403 are compressed, providing force-storing unit 401 with an elastic returning function. First leg 402 of each force-storing unit 401 is connected to second leg 403 of an adjacent force-storing unit 401. Thus, compression section 404 of each force-storing unit 401 possesses an elastic returning function. First leg 402 on an end of elastic element 41 abuts guide 28, and second leg 403 on the other end of elastic element 41 abuts pressing end 352 of guiding slot 35. Thus, slide 30 can be automatically returned to its natural, initial position.

Figure 5:
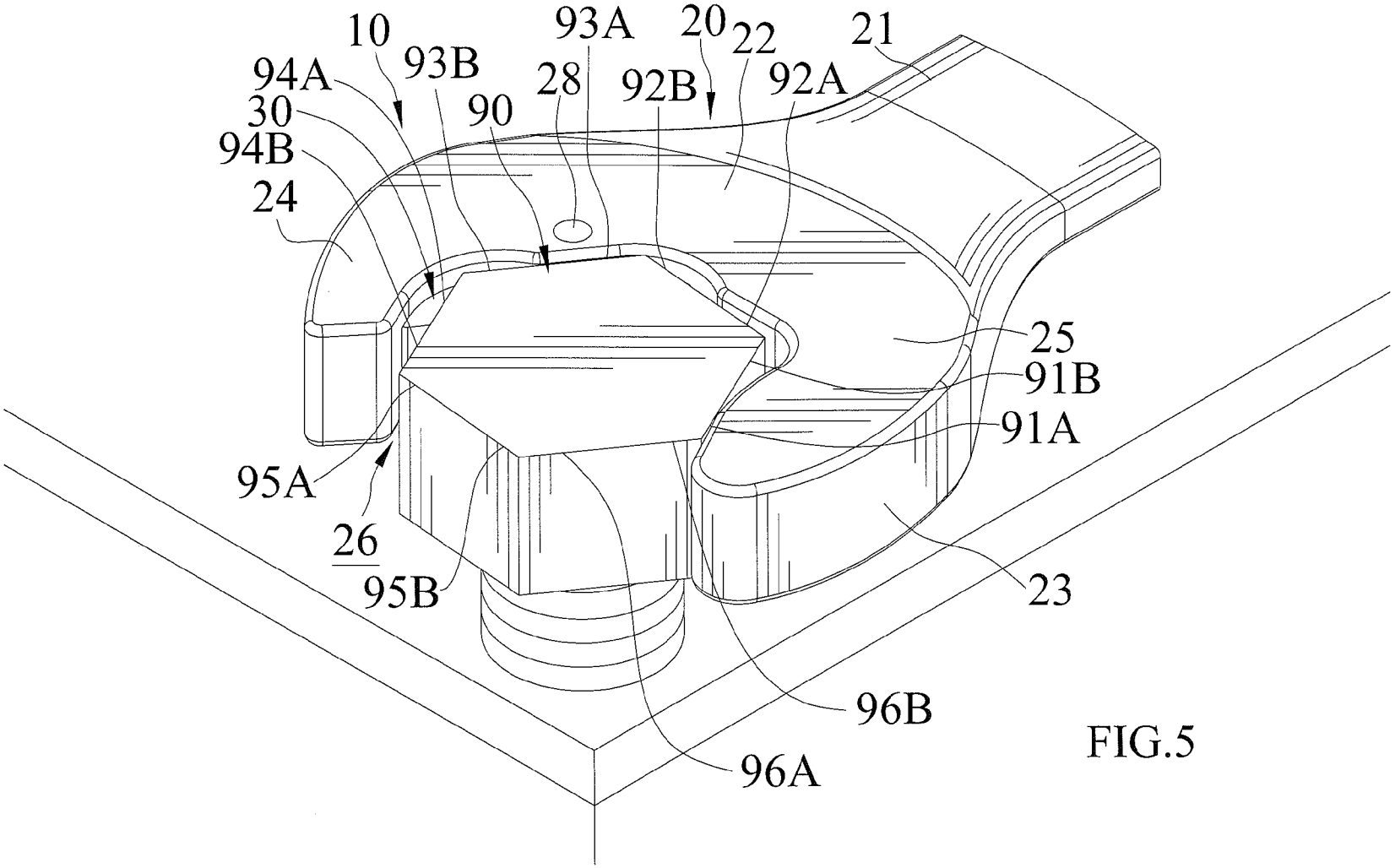
FIG. 5 shows a perspective view illustrating use of the open end wrench of FIG. 1 on a workpiece.
Figure 6:
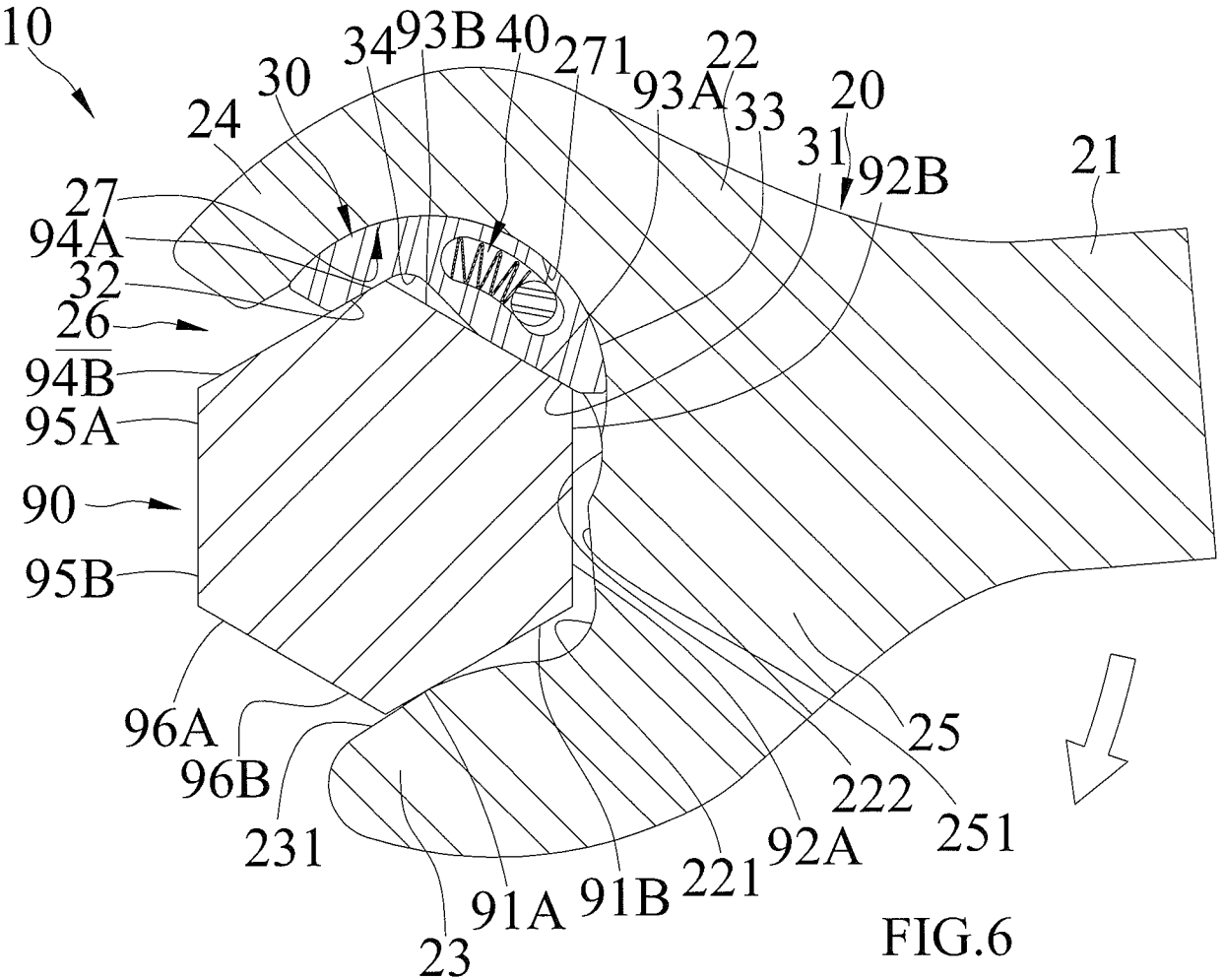
FIG. 6 shows a cross sectional view illustrating rotation of the open end wrench of FIG. 5 in a driving direction to drive the workpiece in the same direction.
Figure 7:
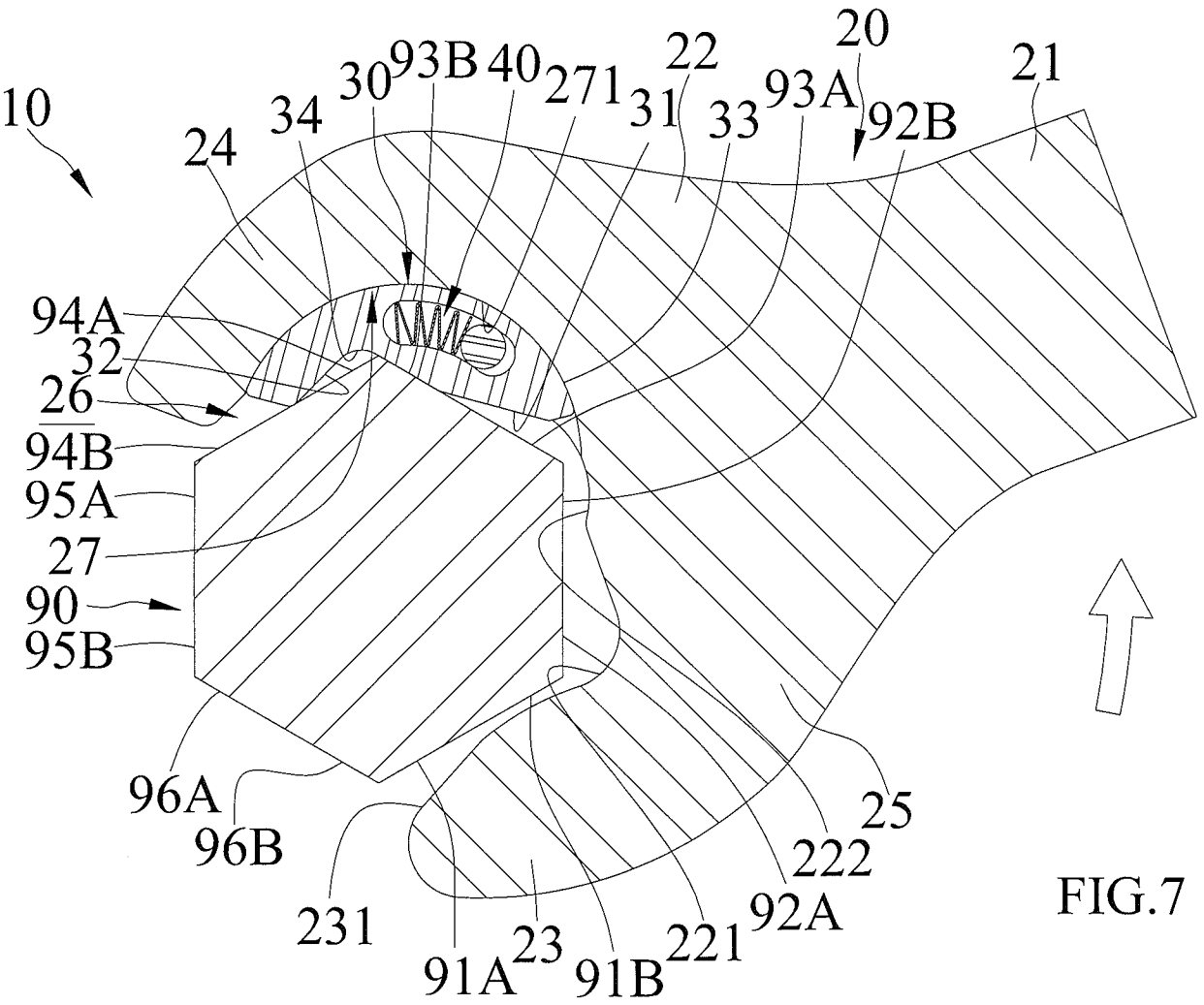
FIG. 7 shows a cross sectional view illustrating rotation of the open end wrench of FIG. 6 in a non-driving direction reverse to the driving direction without driving the workpiece.
Figure 8:
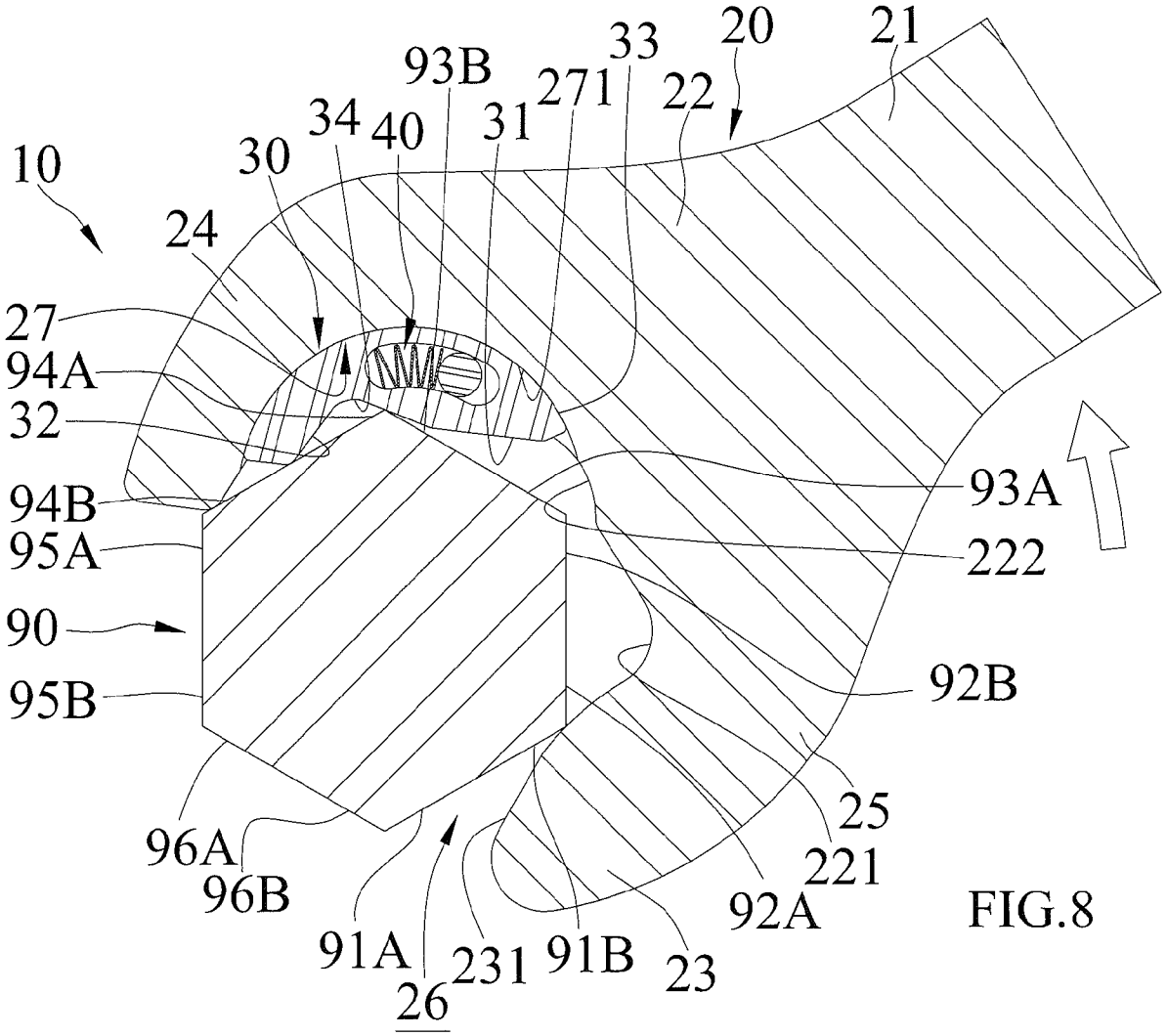
FIG. 8 shows a cross sectional view illustrating further rotation of the open end wrench of FIG. 7 in the non-driving direction.
Figure 9:
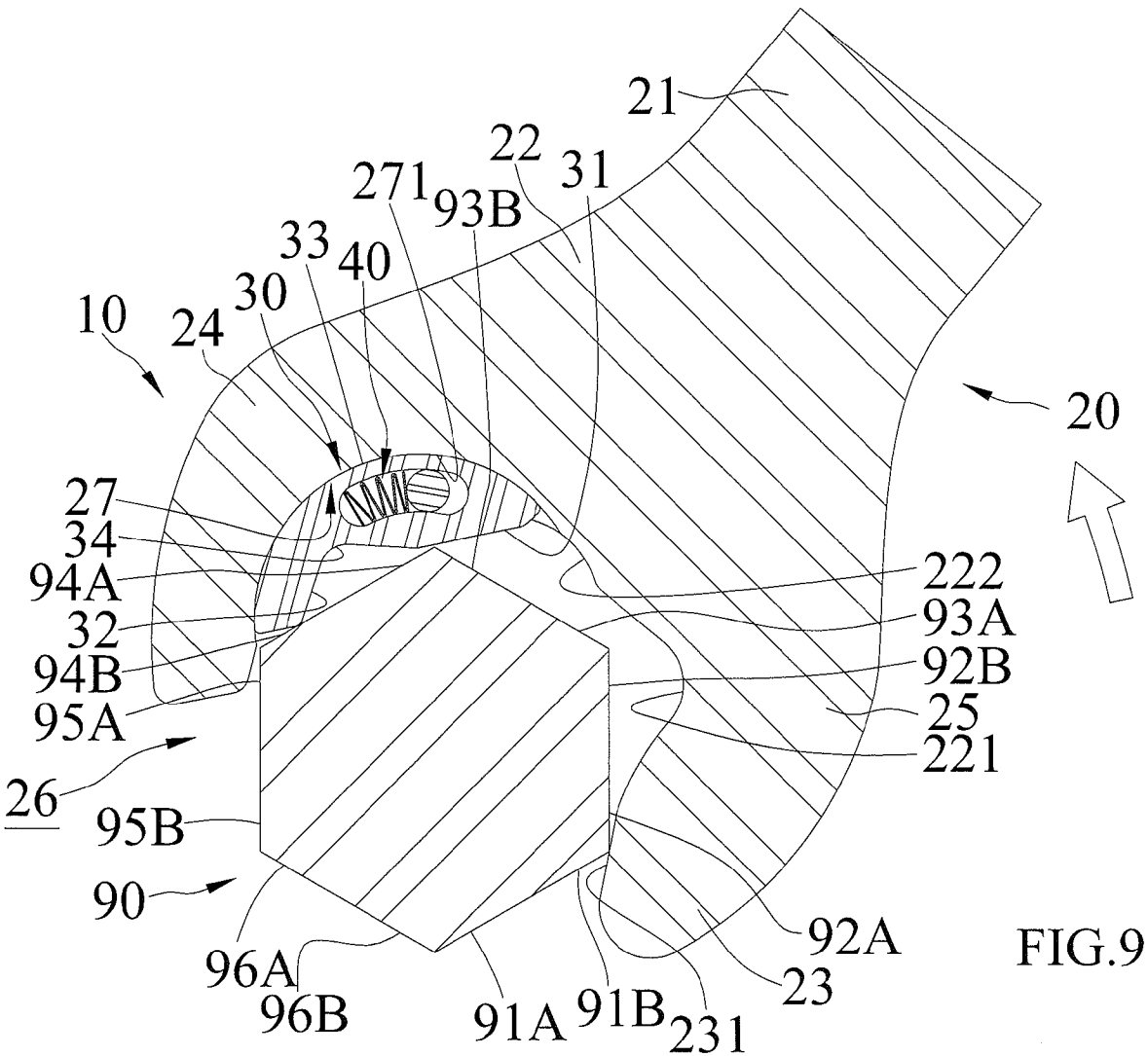
FIG. 9 shows a cross sectional view illustrating further rotation of the open end wrench of FIG. 8 in the non-driving direction.
Figure 10:
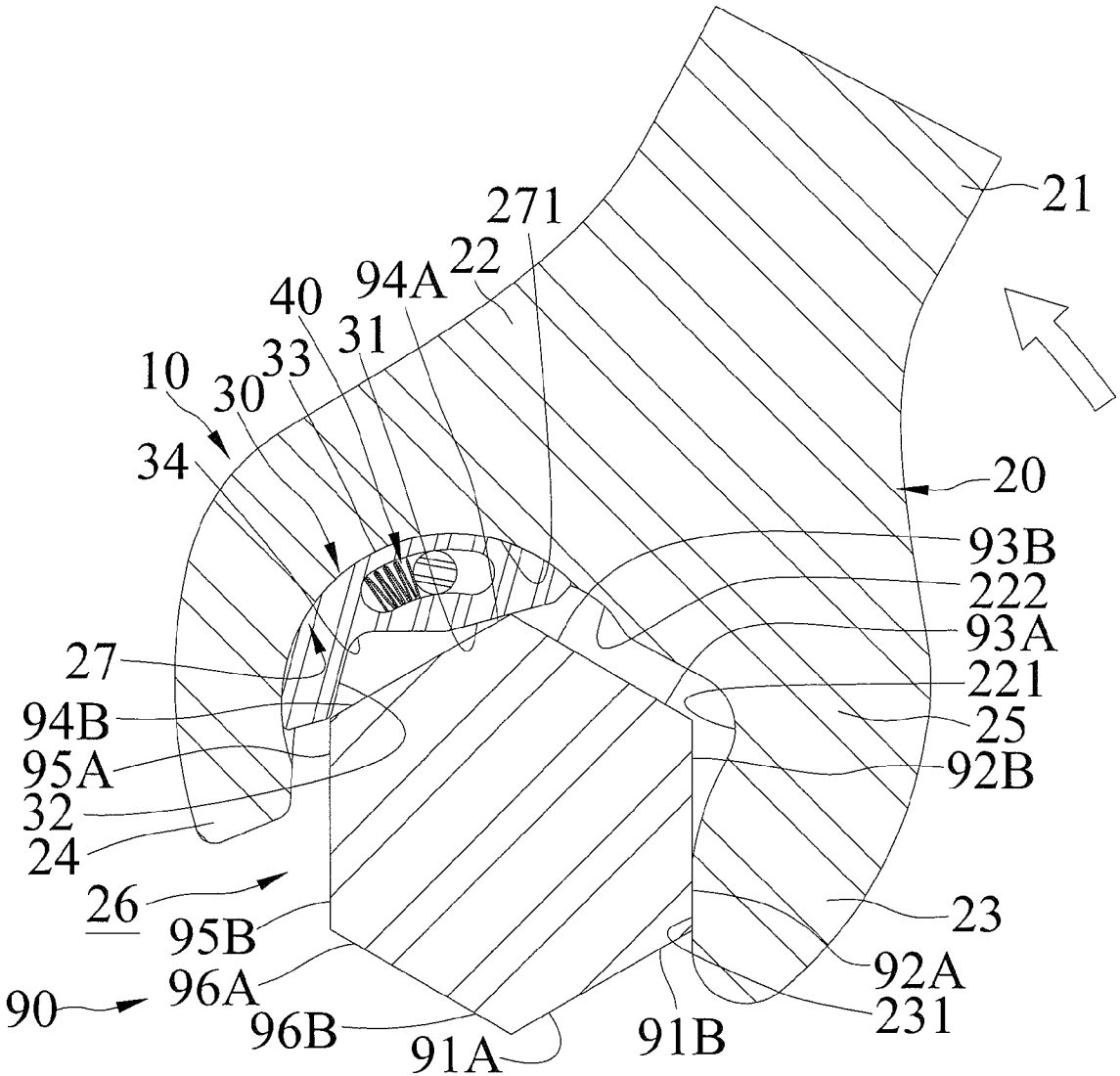
FIG. 10 shows a cross sectional view illustrating further rotation of the open end wrench of FIG. 9 in the non-driving direction.

FIGS. 5 and 6 show rotation of open end wrench 10 according to the preferred teachings of the present invention in the driving direction towards first jaw 23 (the clockwise direction in FIG. 6) to drive workpiece 90. Specifically, when a user intends to rotate workpiece 90, workpiece 90 is firstly entered wrenching space 26 to a driving position with force-applying face 231 of first jaw 23 of jaw portion 22 abutting first force-receiving face in the first rotating direction 91A of workpiece 90 and with first wrenching face 32 of slide 30 abutting fourth force-receiving face in the first rotating direction 94A of workpiece 90.

Since fourth force-receiving face in the first rotating direction 94A of workpiece 90 is parallel to first force-receiving face in the first rotating direction 91A, to make first wrenching face 32 of slide 30 be in surface contact with fourth force-receiving face in the first rotating direction 94A, elastic device 40 in slide 30 is compressed and deformed to move slide 30 along the arcuate path such that first wrenching face 32 of slide 30 can automatically abut fourth force-receiving face in the first rotating direction 94A while first wrenching face 32 of slide 30 is substantially parallel to force-applying face 231 of first jaw 23.

In this case, the user can drive handle 21 in the clockwise direction to rotate jaw portion 22 about the center of workpiece 90. The force applied by the user is transmitted through force-applying face 231 of first jaw 23 to first force-receiving face in the first rotating direction 91A of workpiece 90. At the same time, the force applied by the user is transmitted through first wrenching face 32 of slide 30 to fourth force-receiving face in the first rotating direction 94A of workpiece 90. Thus, workpiece 90 rotates together with jaw portion 22.

Since first jaw 23 and jaw portion 22 are integrally formed as a single and inseparable component of the same material, force-applying face 231 of first jaw 23 can effectively withstand the reactive force from first force-receiving face in the first rotating direction 91A of workpiece 90. Furthermore, since second jaw 24 and jaw portion 22 are integrally formed as a single and inseparable component of the same material and since sliding face 31 of slide 30 and sliding wall 271 of sliding groove 27 are free of holes, grooves, recesses, etc., have the same curvature and are in surface contact with each other, first wrenching face 32 of slide 30 can effectively withstand the reactive force from fourth force-receiving face in the first rotating direction 94A of workpiece 90. Thus, open end wrench 10 according to the preferred teachings of the present invention can withstand high-torque operation.

In this embodiment, second wrenching face 33 of slide 30 abuts third force-receiving face in the first rotating direction 93A of workpiece 90. Since second jaw 24 and jaw portion 22 are integrally formed as a single and inseparable component of the same material and since sliding face 31 of slide 30 and sliding wall 271 of sliding groove 27 are free of holes, grooves, recesses, etc., have the same curvature and are in surface contact with each other, second wrenching face 33 of slide 30 can effectively withstand the reactive force from third force-receiving face in the first rotating direction 93A of workpiece 90. Thus, open end wrench 10 according to the preferred teachings of the present invention can withstand high-torque operation.

FIGS. 7-10 show rotation of open end wrench 10 according to the preferred teachings of the present invention in the opposite, non-driving direction towards second jaw 24 (the counterclockwise direction in FIGS. 7-10) without driving workpiece 90. Namely, open end wrench 10 is moved in the opposite direction back to a position ready for driving workpiece 90 without the need of disengaging workpiece 90 from wrenching space 26 of jaw portion 22 and subsequent reengaging workpiece 90 in wrenching space 26, allowing fast driving of workpiece 90.

When the user moves handle 21 in the counterclockwise direction, jaw portion 22 and handle 21 rotate freely relative to workpiece 90 such that first and second evasive portions 221 and 222 of jaw portion 22 and evasive portion 34 of slide 30 respectively approach first, second, and third force-receiving faces in the second rotating direction 91B, 92B, and 93B of workpiece 90. Namely, first, second, and third force-receiving faces in the second rotating direction 91B, 92B, and 93B of workpiece 90 enter first and second evasive portions 221 and 222 and evasive portion 34.

Further rotation of jaw portion 22 in the counterclockwise direction causes evasive portion 34 of slide 30 to come into contact with third force-receiving face in the second rotating direction 93B of workpiece 90. In this case, elastic element 40 is compressed and moves slide 30 in sliding groove 27 along the arcuate path.

When slide 30 is pressed and moved along the arcuate path relative to jaw portion 22, jaw portion 22 can continue its rotation in the counterclockwise direction. Next, force-applying face 231 of first jaw 23 moves across first force-receiving face in the second rotating direction 91B of workpiece 90 and approaches second force-receiving face in the first rotating direction 92A of workpiece 90. At the same time, first wrenching face 32 of slide 30 moves across fourth force-receiving face in the second rotating direction 94B of workpiece 90 and approaches fifth force-receiving face in the first rotating direction 95A of workpiece 90. In this embodiment, second wrenching face 33 of slide 30 also moves across third force-receiving face in the second rotating direction 93B of workpiece 90 and approaches fourth force-receiving face in the first rotating direction 94A of workpiece 90.

Figure 11:
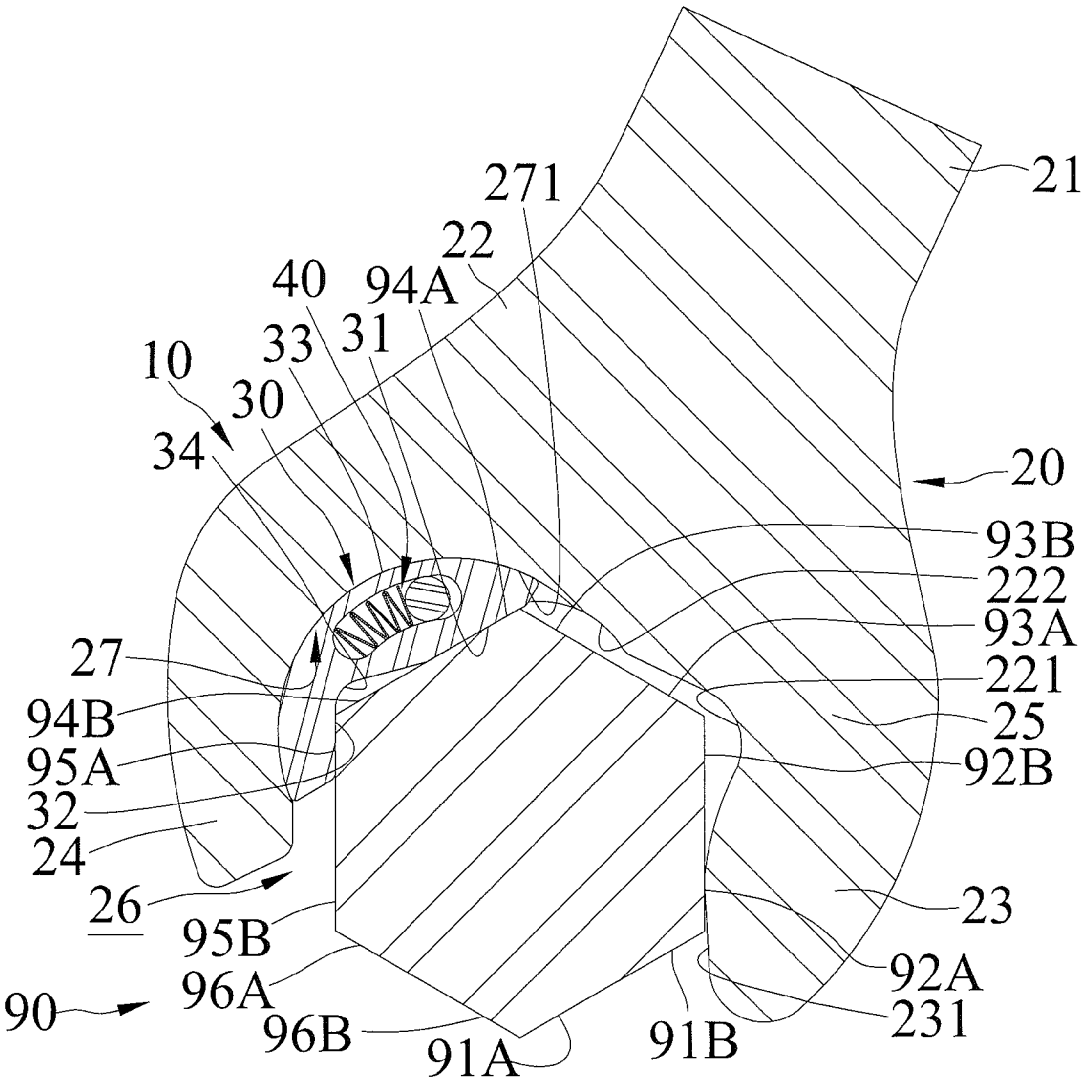
FIG. 11 shows a cross sectional view of the open end wrench in a next operative position.

With reference to FIG. 11, when force-applying face 231 of first jaw 23 abuts second force-receiving face in the first rotating direction 92A of workpiece 90, elastic device 40 returns slide 30 and makes first wrenching face 32 of slide 30 abut fifth force-receiving face in the first rotating direction 95A of workpiece 90. Furthermore, first wrenching face 32 of slide 30 automatically comes in surface contact with fifth force-receiving face in the first rotating direction 95A of workpiece 90 such that first wrenching face 32 of slide 30 is substantially parallel to force-applying face 231 of first jaw 23, reliably positioning jaw portion 22 in the new driving position ready for driving workpiece 90 in the clockwise direction without the need of disengaging workpiece 90 from wrenching space 26 of jaw portion 22 and subsequent reengaging workpiece 90 in wrenching space 26, allowing fast driving of workpiece 90.

Thus, open end wrench 10 returns to the next driving position and is in a state similar to that shown in FIG. 6. The user can again rotate handle 21 in the clockwise direction to make jaw portion 22 rotate about the axis of workpiece 90 and, thus, drive workpiece 90 in the clockwise direction.

Figure 12:
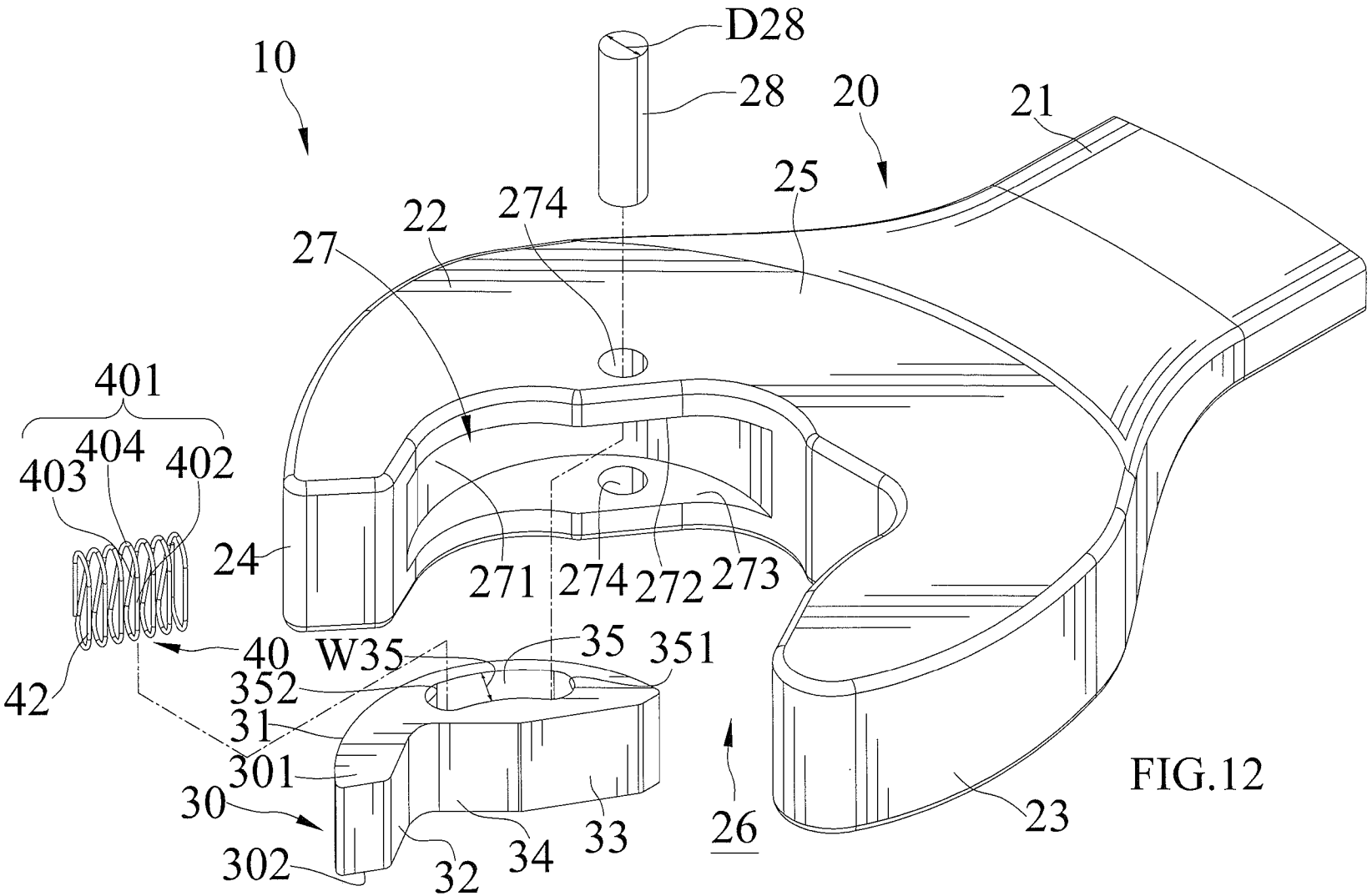
FIG. 12 shows a partial, exploded, perspective view of an open end wrench of a second embodiment according to the preferred teachings of the present invention.
Figure 13:
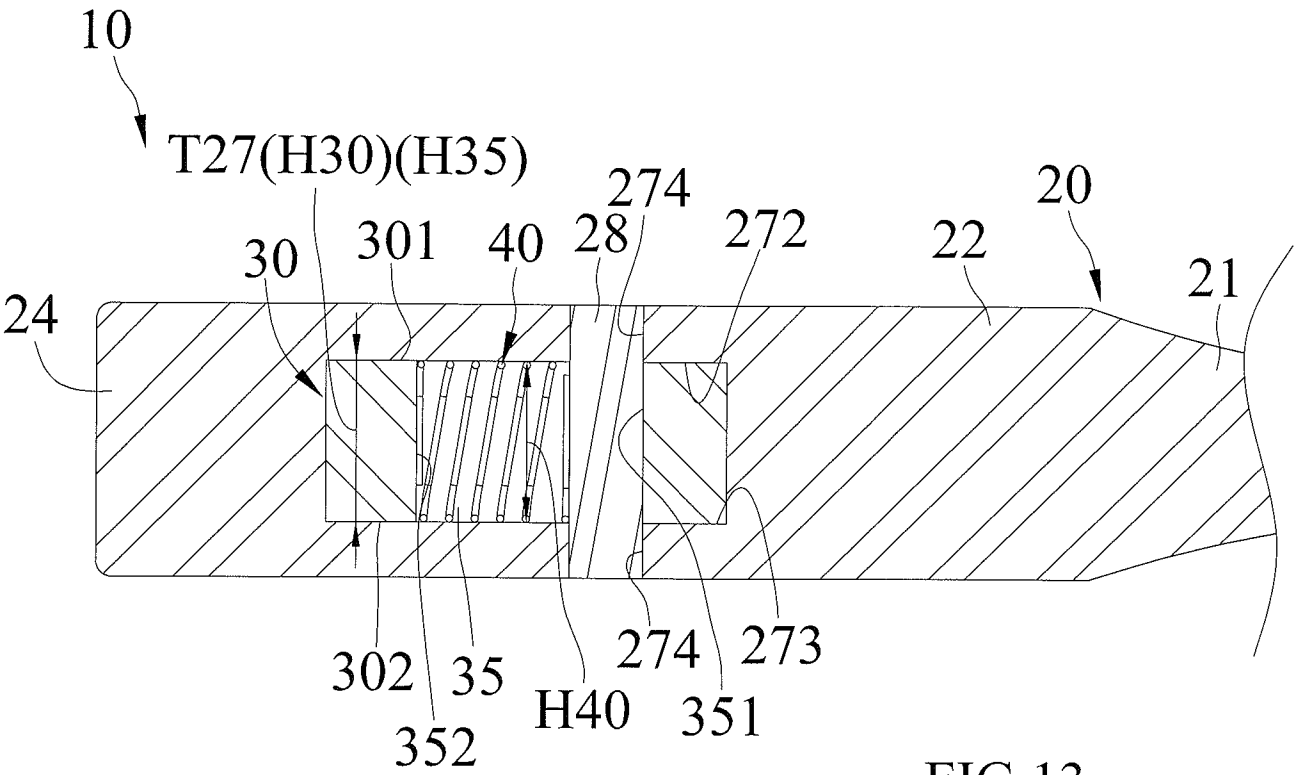
FIG. 13 shows a partial, cross sectional view of the open end wrench of FIG. 12.
Figure 14:
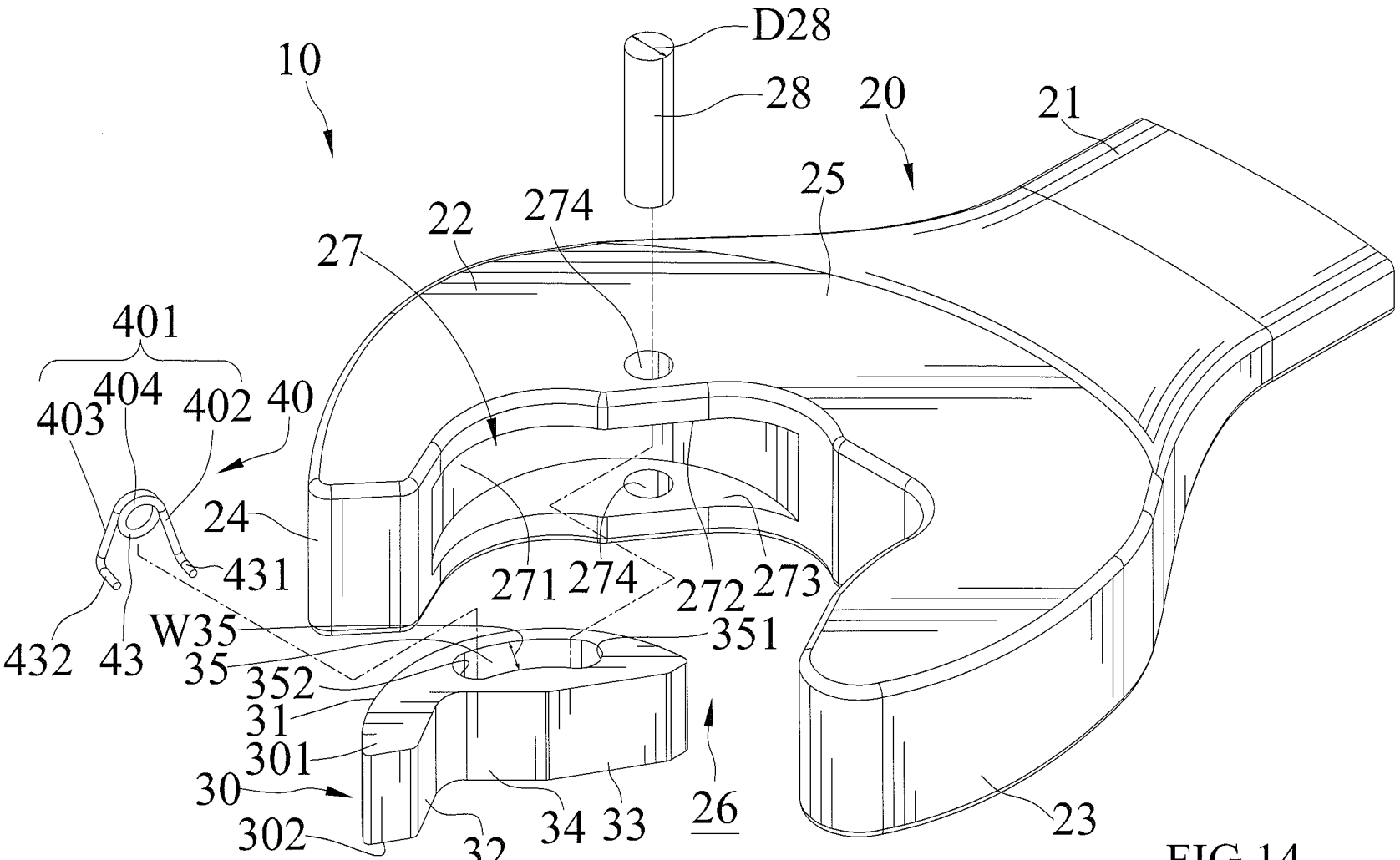
FIG. 14 shows a partial, exploded, perspective view of an open end wrench of a third embodiment according to the preferred teachings of the present invention.
Figure 15:
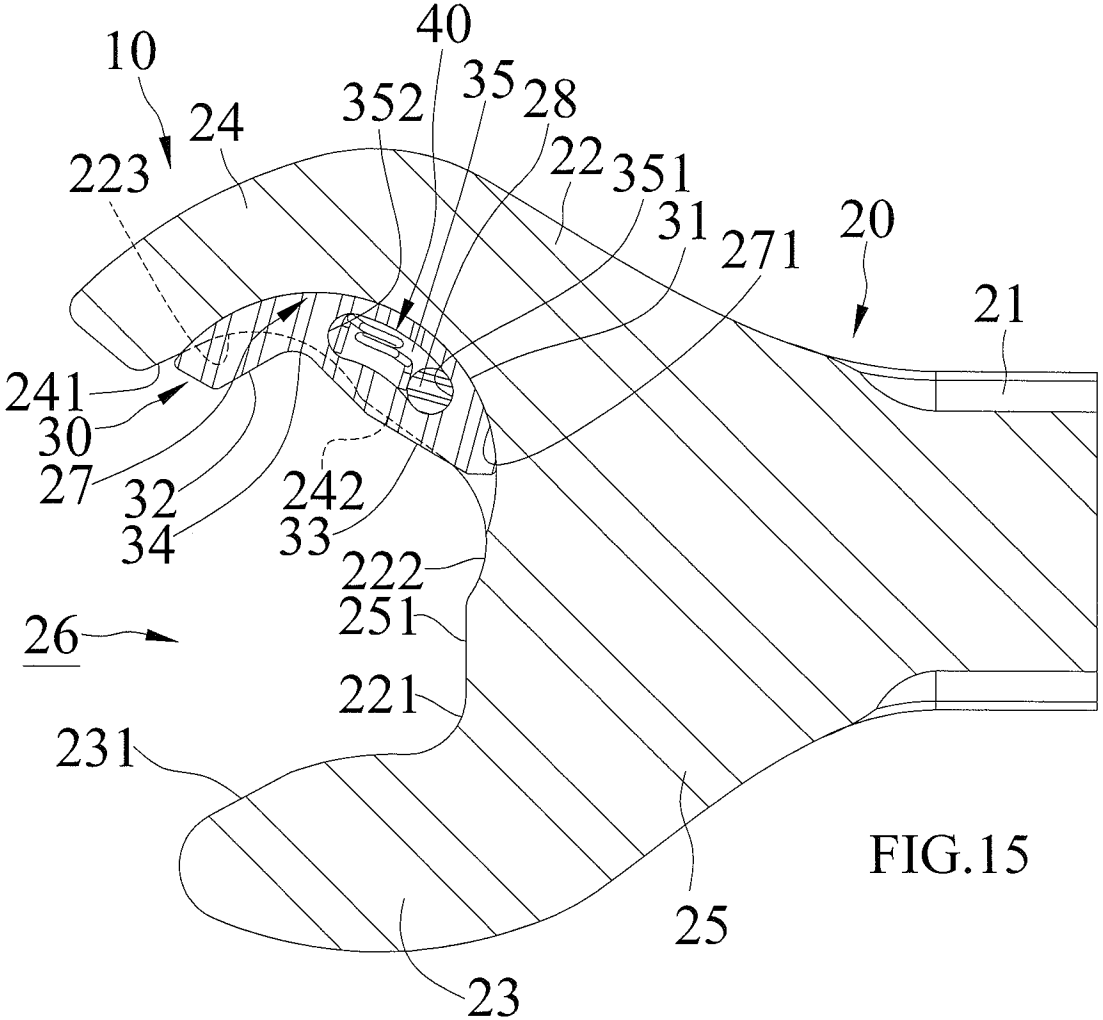
FIG. 15 shows a partial, cross sectional view of the open end wrench of FIG. 14.
Figure 16:
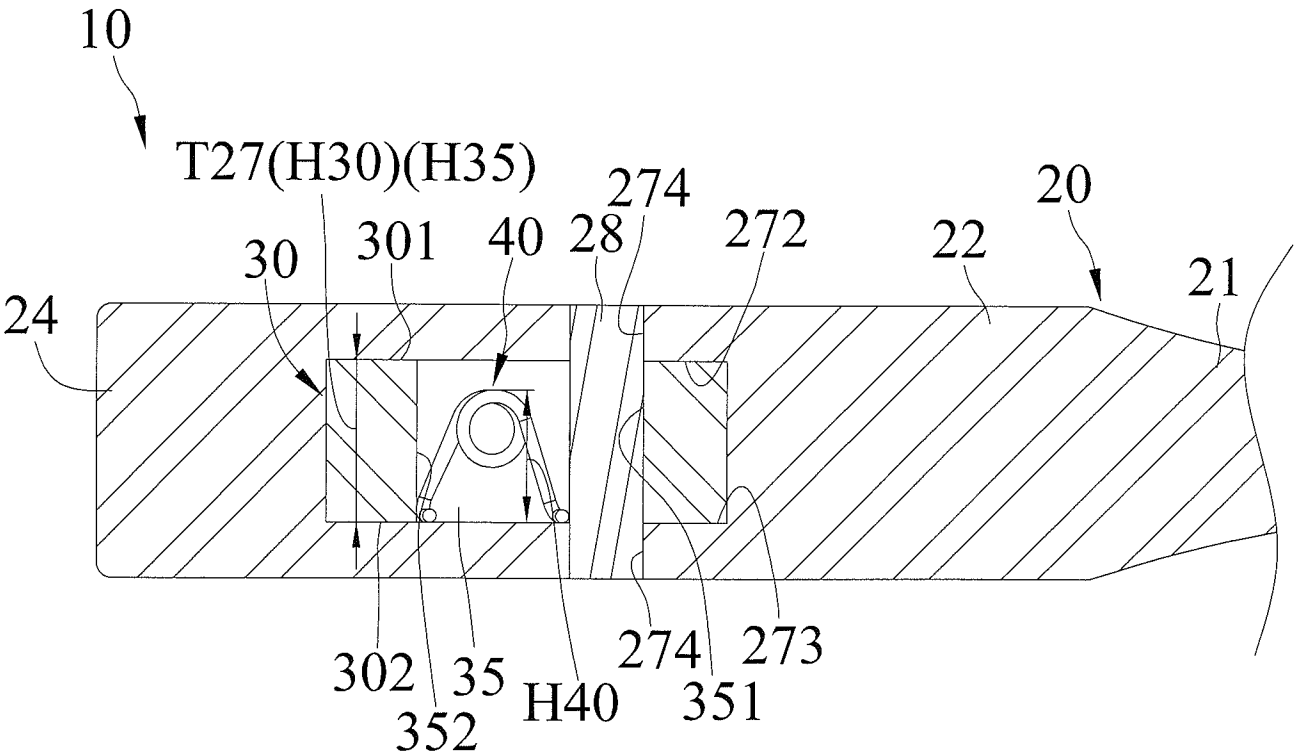
FIG. 16 shows another partial, cross sectional view of the open end wrench of FIG. 14.
Figure 17:
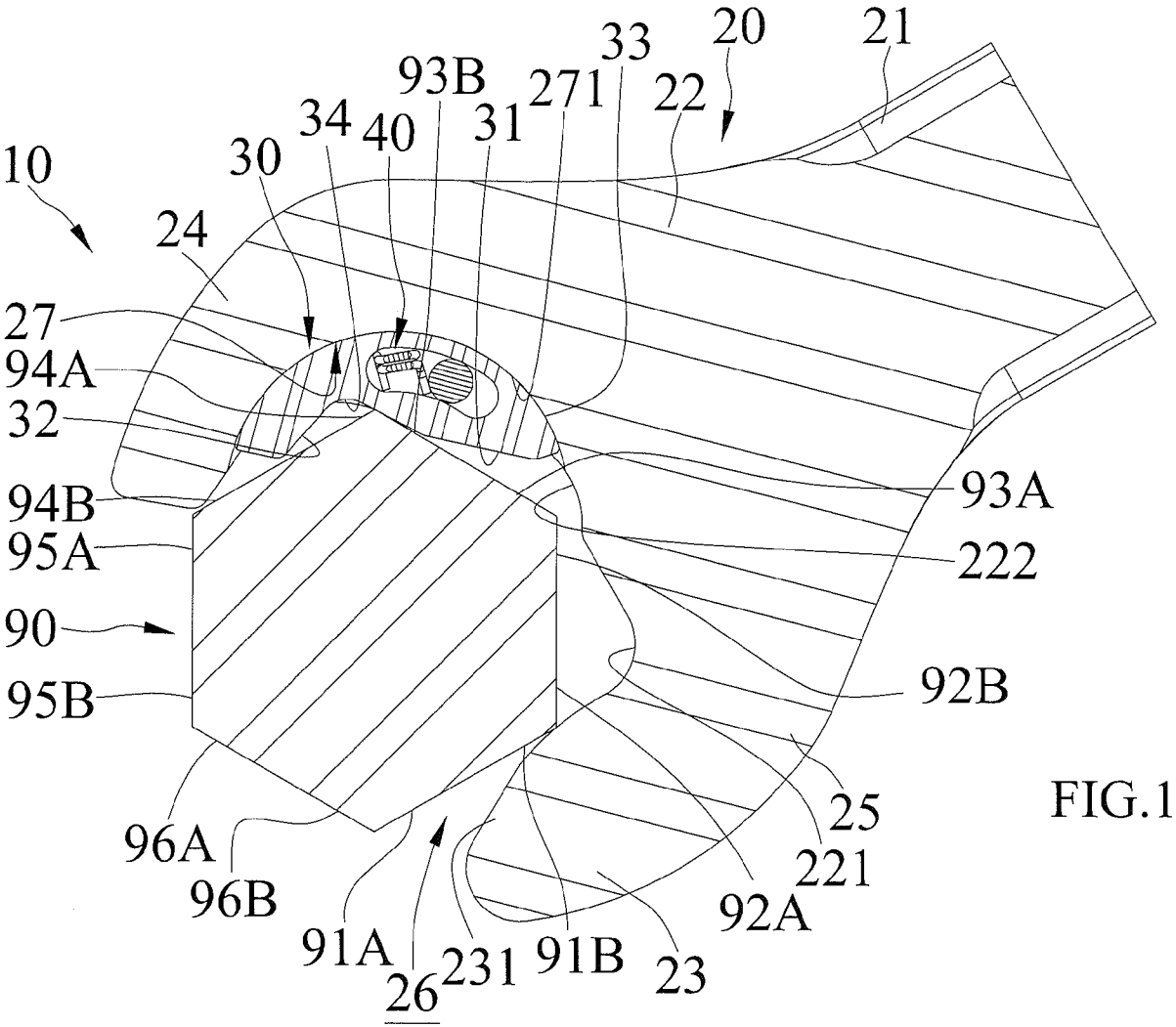
FIG. 17 shows a partial, cross sectional view illustrating use of the open end wrench of FIG. 14 on a workpiece.

FIGS. 12 and 13 show an open end wrench 10 of a second embodiment according to the preferred teachings of the present invention that is substantially the same as the first embodiment except for elastic device 40.

Two ends of elastic device 40 respectively abut guide 28 and pressing end 352 of guiding slot 35 for returning slide 30 to its natural, initial position. Elastic device 40 includes an elastic element 42 mounted in guiding slot 35 of slide 30. Elastic element 42 has a height H40 in the height direction of slide 30 not larger than height H35 but larger than width W35 of guiding slot 35. Furthermore, height H40 of elastic element 42 is larger than 0.5 times height H35 of guiding slot 35. Thus, rotation of elastic element 42 in guiding slot 35 is avoided, preventing slide 30 from shifting from its natural, initial position after returning.

In this embodiment, elastic element 42 is a compression spring having Z-shaped cross sections. At least one force-storing unit 401 is provided between two ends of elastic element 42. Each force-storing unit 401 is in the form of a metal wire having substantially V-shaped cross sections. Each force-storing unit 401 includes first and second legs 402 and 403 and a compression section 404 between first and second legs 402 and 403. Compression section 404 can store energy when first and second legs 402 and 403 are compressed, providing force-storing unit 401 with elastic returning function. First leg 402 of each force-storing unit 401 is connected to second leg 403 of an adjacent force-storing unit 401. Thus, compression section 404 of each force-storing unit 401 possesses elastic returning function. First leg 402 on an end of elastic element 42 abuts guide 28, and second leg 403 on the other end of elastic element 42 abuts pressing end 352 of guiding slot 35. Thus, slide 30 can be automatically returned to its natural, initial position.

FIGS. 14-17 show an open end wrench 10 of a third embodiment according to the preferred teachings of the present invention that is substantially the same as the first embodiment except for elastic device 40.

Two ends of elastic device 40 respectively abut guide 28 and pressing end 352 of guiding slot 35 for returning slide 30 to its natural, initial position. Elastic device 40 includes an elastic element 43 mounted in guiding slot 35 of slide 30. Elastic element 43 has a height H40 in the height direction of slide 30 not larger than height H35 but larger than width W35 of guiding slot 35. Furthermore, height H40 of elastic element 43 is larger than 0.5 times height H35 of guiding slot 35. Thus, rotation of elastic element 43 in guiding slot 35 is avoided, preventing slide 30 from shifting from its natural, initial position after returning.

In this embodiment, elastic element 42 is a compression spring having Z-shaped cross sections. At least one force-storing unit 401 is provided between two ends of elastic element 42. Each force-storing unit 401 is in the form of a metal wire having substantially V-shaped cross sections. Each force-storing unit 401 includes first and second legs 402 and 403 and a compression section 404 between first and second legs 402 and 403. Compression section 404 can store energy when first and second legs 402 and 403 are compressed, providing force-storing unit 401 with an elastic returning function. First leg 402 of each force-storing unit 401 is connected to second leg 403 of an adjacent force-storing unit 401. Thus, compression section 404 of each force-storing unit 401 possesses an elastic returning function. First leg 402 on an end of elastic element 42 abuts guide 28, and second leg 403 on the other end of elastic element 42 abuts pressing end 352 of guiding slot 35. Thus, slide 30 can be automatically returned to its natural, initial position.

It can be appreciated that elastic element 43 does not have to include second connection unit 432, and second leg 403 of force-storing unit 301 can directly abut pressing end 352 of guiding slot 35, providing the same returning effect for slide 30.

Figure 18:
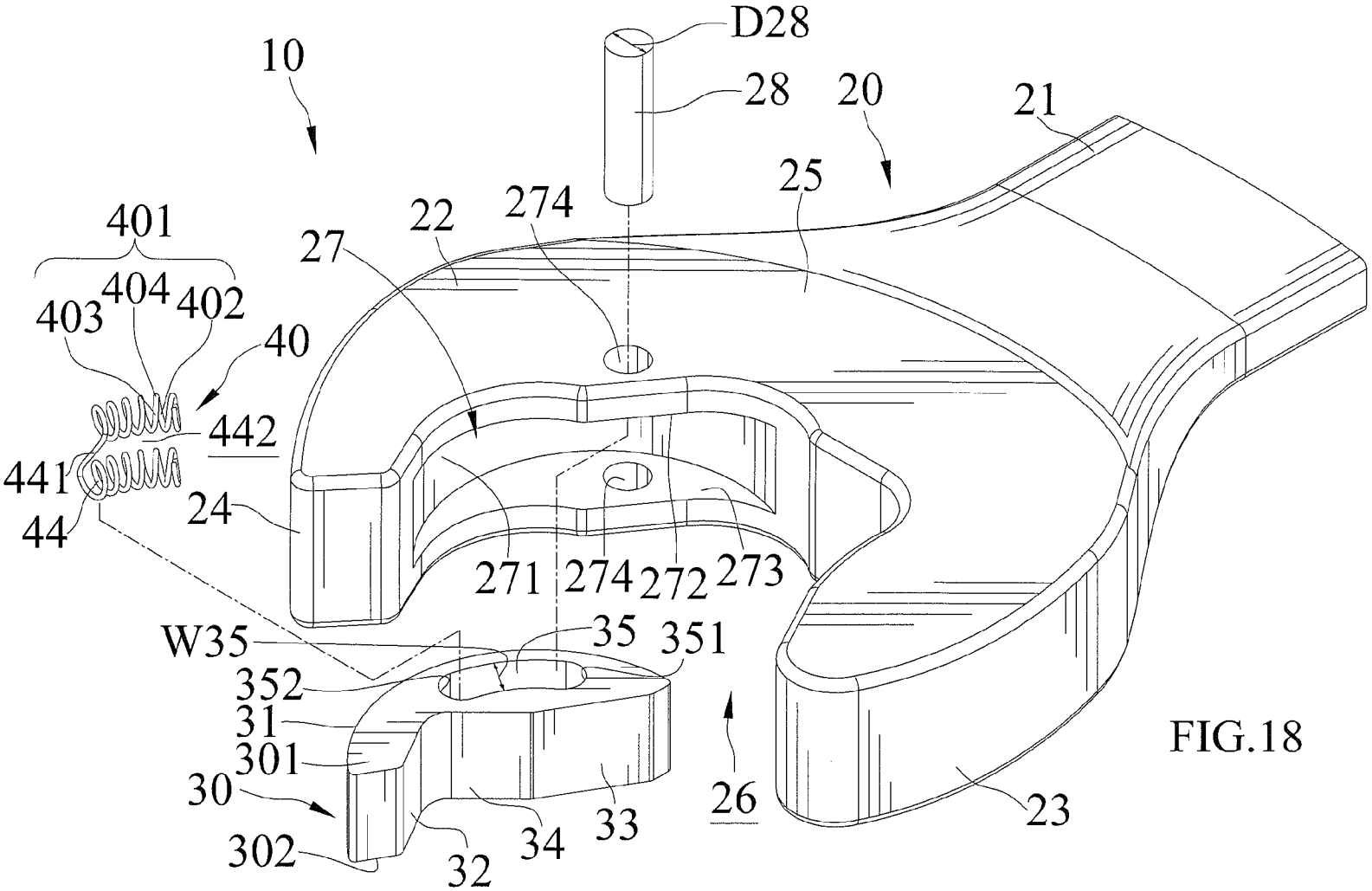
FIG. 18 shows a partial, exploded, perspective view of an open end wrench of a fourth embodiment according to the preferred teachings of the present invention.
Figure 19:
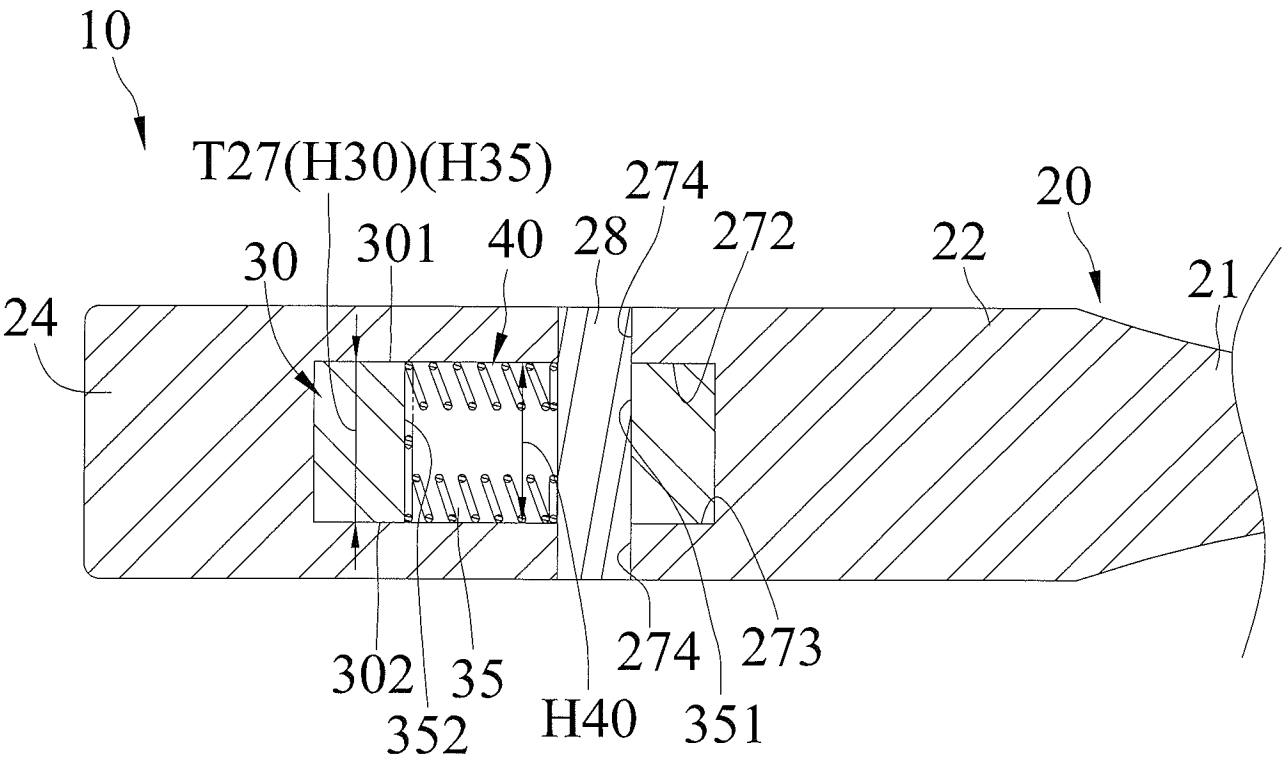
FIG. 19 shows a partial, cross sectional view of the open end wrench of FIG. 18.
Figure 20:
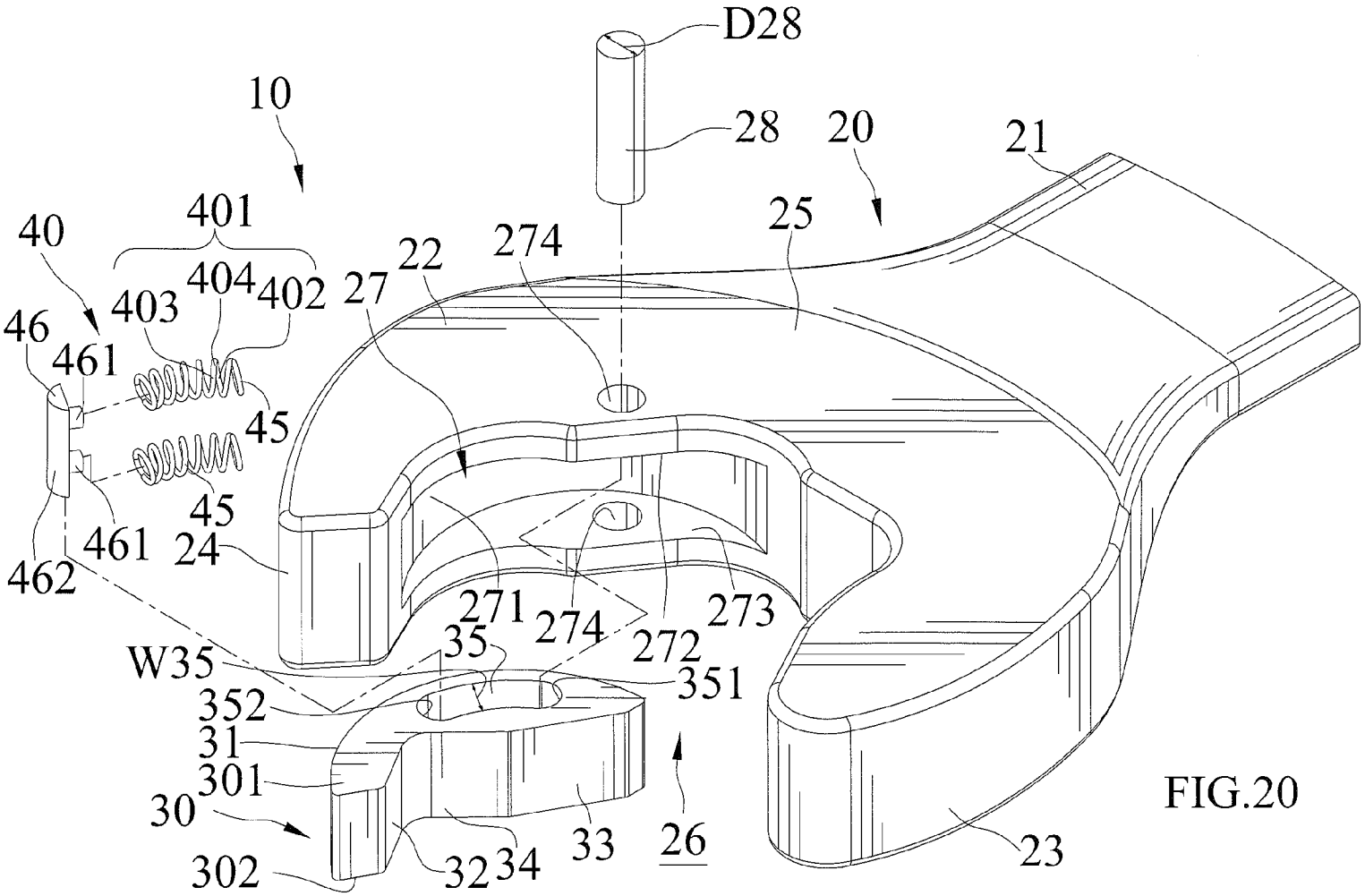
FIG. 20 shows a partial, exploded, perspective view of an open end wrench of a fifth embodiment according to the preferred teachings of the present invention.
Figure 21:
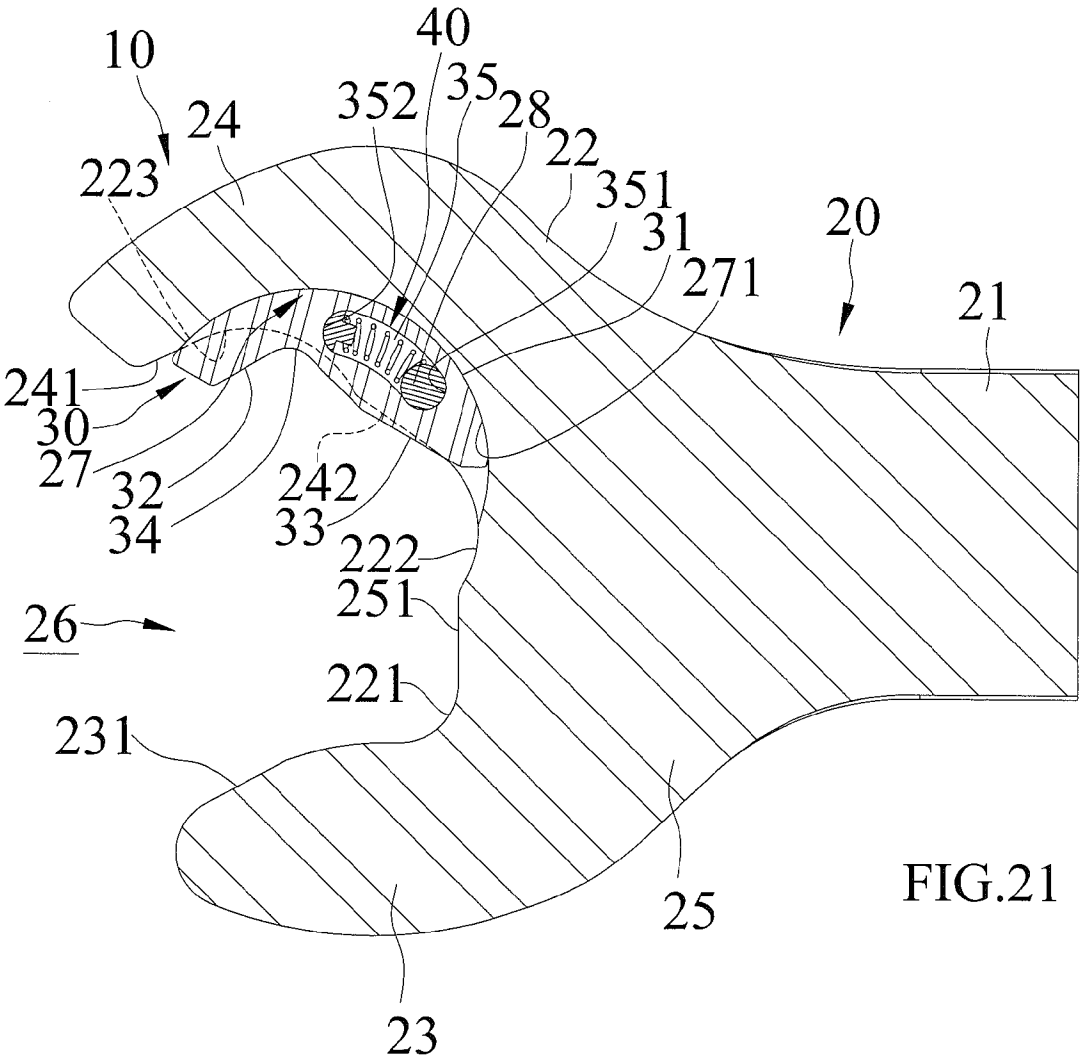
FIG. 21 shows a partial, cross sectional view of the open end wrench of FIG. 20.
Figure 22:
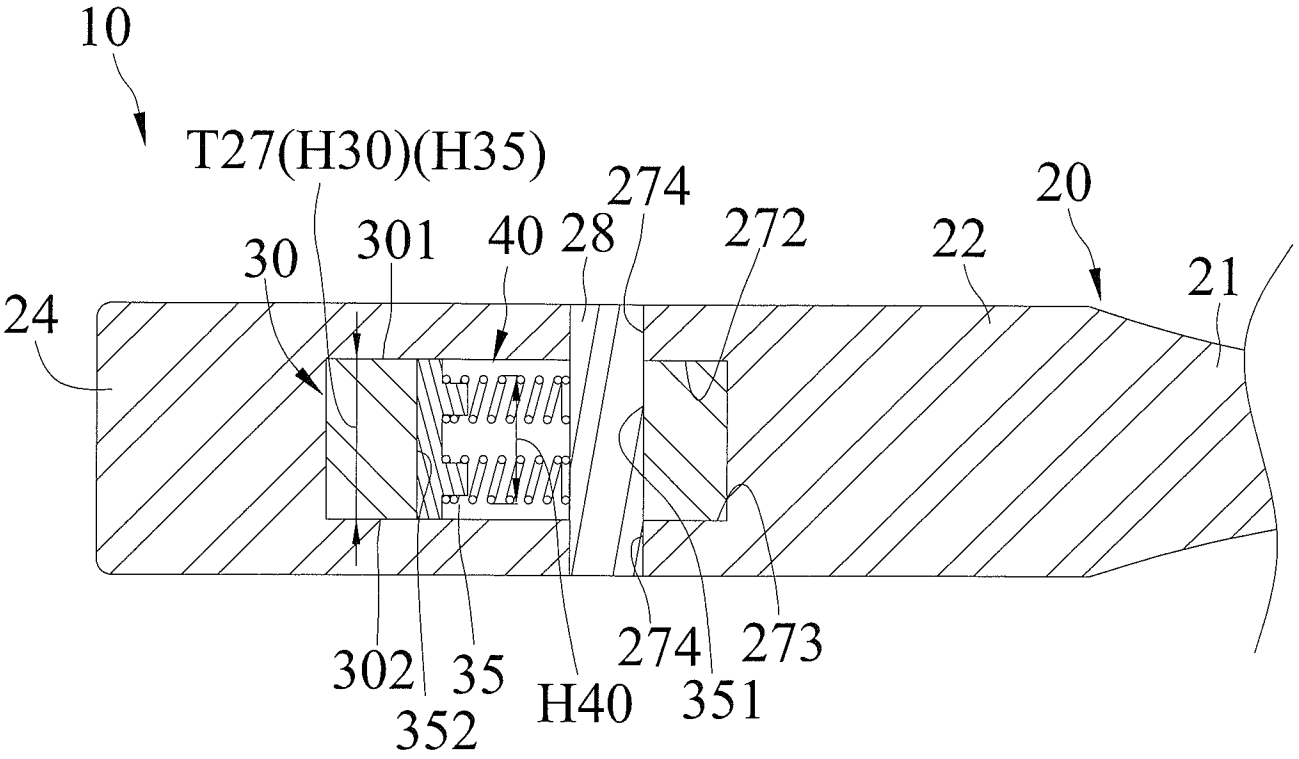
FIG. 22 shows another partial, cross sectional view of the open end wrench of FIG. 20.
Figure 23:
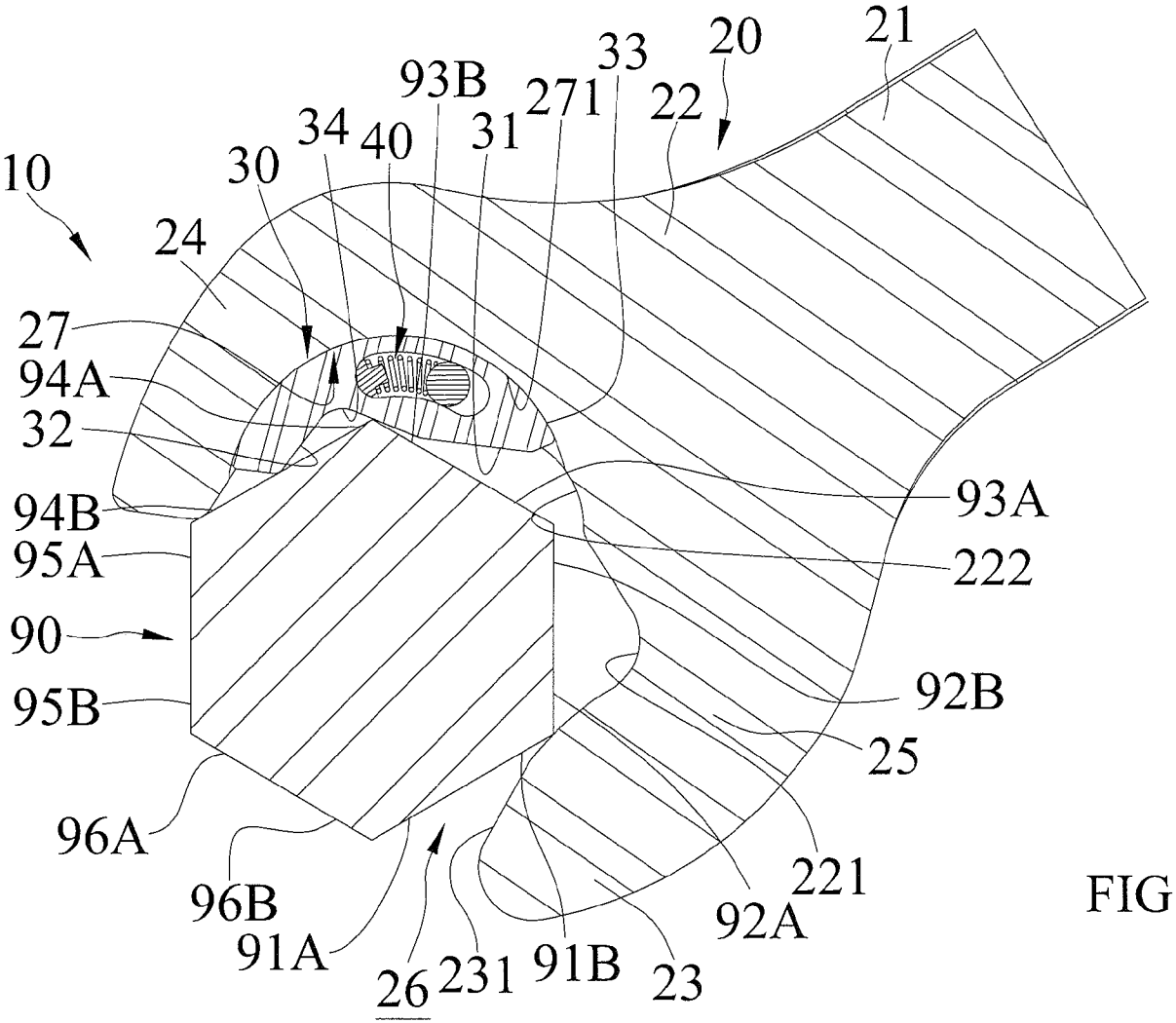
FIG. 23 shows a partial, cross sectional view illustrating use of the open end wrench of FIG. 20 on a workpiece.
Figure 24:
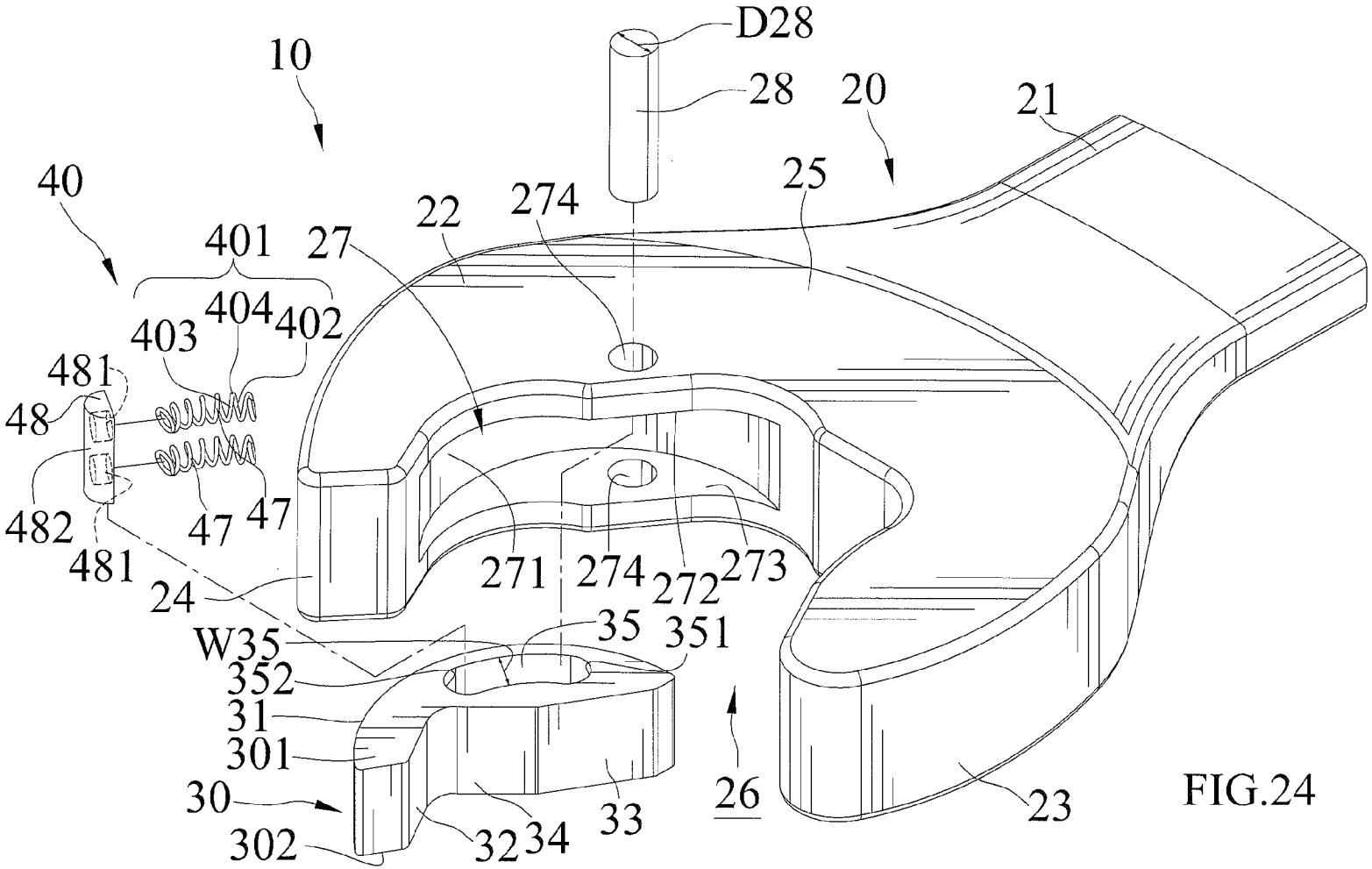
FIG. 24 shows a partial, exploded, perspective view of an open end wrench of a sixth embodiment according to the preferred teachings of the present invention.
Figure 25:
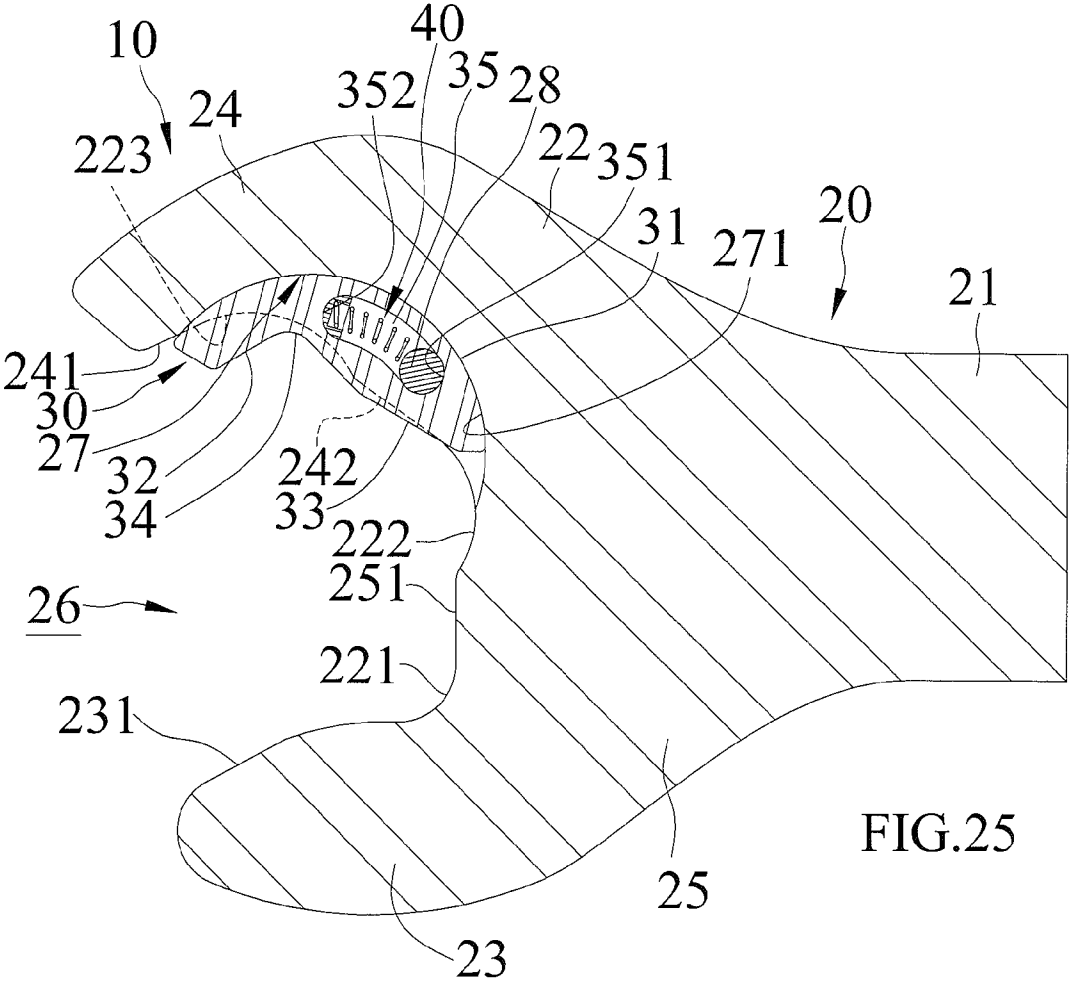
FIG. 25 shows a partial, cross sectional view of the open end wrench of FIG. 24.
Figure 26:
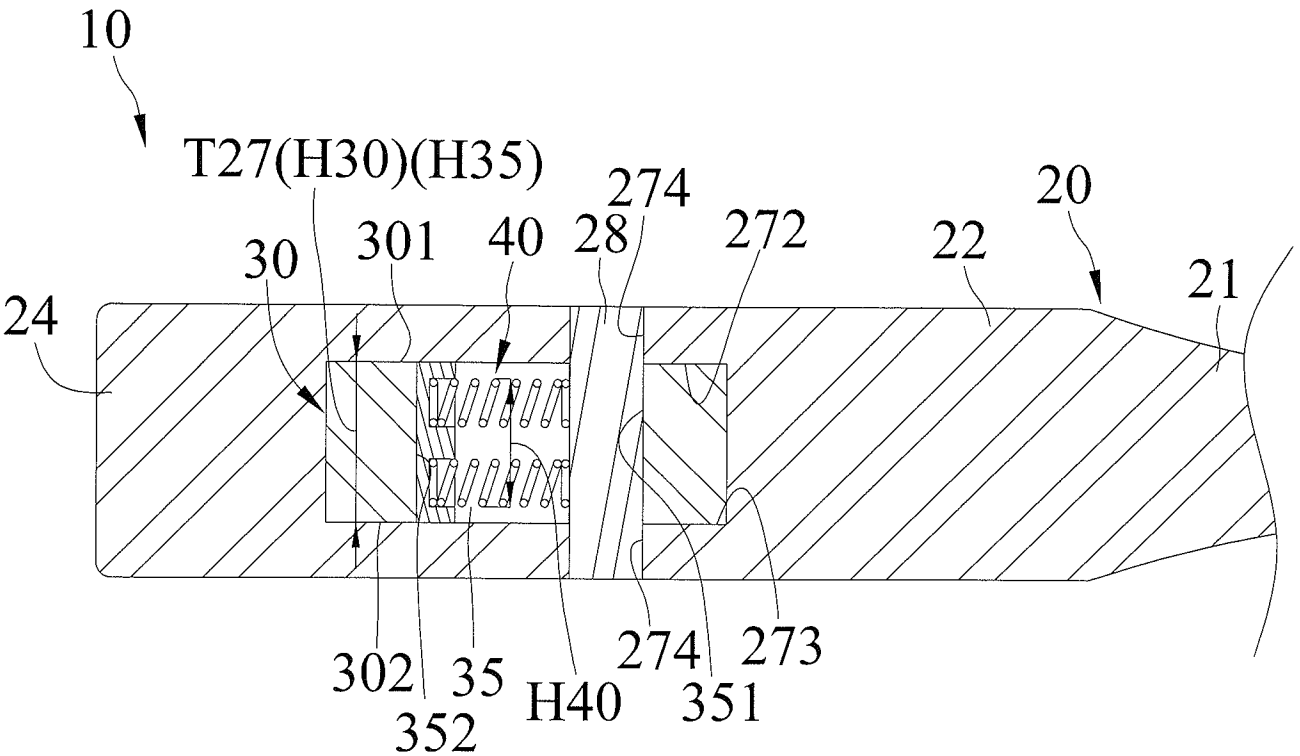
FIG. 26 shows another partial, cross sectional view of the open end wrench of FIG. 24.
Figure 27:
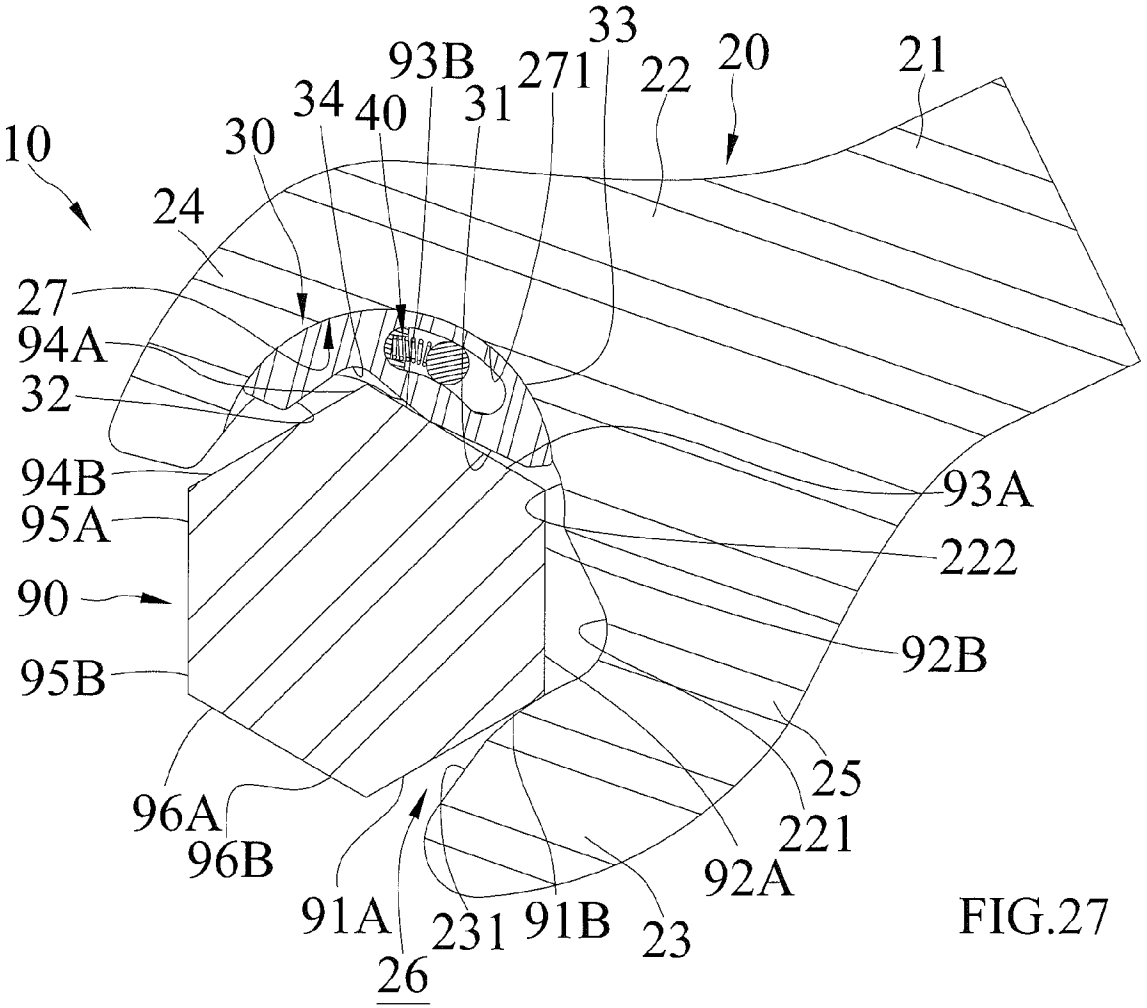
FIG. 27 shows a partial, cross sectional view illustrating use of the open end wrench of FIG. 24 on a workpiece.

FIGS. 18 and 19 show an open end wrench 10 of a fourth embodiment according to the preferred teachings of the present invention that is substantially the same as the first embodiment except for elastic device 40.

Two ends of elastic device 40 respectively abut guide 28 and pressing end 352 of guiding slot 35 for returning slide 30 to its natural, initial position. Elastic device 40 includes an elastic element 44 mounted in guiding slot 35 of slide 30. Elastic element 44 has a height H40 in the height direction of slide 30 not larger than height H35 but larger than width W35 of guiding slot 35. Furthermore, height H40 of elastic element 44 is larger than 0.5 times height H35 of guiding slot 35. Thus, rotation of elastic element 44 in guiding slot 35 is avoided, preventing slide 30 from shifting from its natural, initial position after returning.

In this embodiment, elastic element 44 is a compression spring having upper and lower sections interconnected by a connecting section 441 with a spacing 442 formed between the upper and lower sections spaced in the height direction of slide 30. At least one force-storing unit 401 is provided between two ends of each of the upper and lower sections of elastic element 44. Each force-storing unit 401 is in the form of a metal wire having substantially V-shaped cross sections. Each force-storing unit 401 includes first and second legs 402 and 403 and a compression section 404 between first and second legs 402 and 403. Compression section 404 can store energy when first and second legs 402 and 403 are compressed, providing force-storing unit 401 with an elastic returning function. First leg 402 of each force-storing unit 401 is connected to second leg 403 of an adjacent force-storing unit 401. Thus, compression section 404 of each force-storing unit 401 possesses an elastic returning function. First leg 402 on an end of each of the upper and lower sections of elastic element 44 abuts guide 28. Second legs 403 on the other ends of the upper and lower sections of elastic element 44 are interconnected by connecting section 441 and abut pressing end 352 of guiding slot 35. Thus, slide 30 can be automatically returned to its natural, initial position.

FIGS. 20-23 show an open end wrench 10 of a fifth embodiment according to the preferred teachings of the present invention that is substantially the same as the above embodiments except for elastic device 40.

Two ends of elastic device 40 respectively abut guide 28 and pressing end 352 of guiding slot 35 for returning slide 30 to its natural, initial position. Elastic device 40 is mounted in guiding slot 35 of slide 30 and includes a base 46 and two elastic elements 45 mounted to a side of base 46 and spaced from each other in the height direction of slide 30. An overall height 1140 of elastic elements 45 attached to base 46 in the height direction of slide 30 is not larger than height H35 but larger than width W35 of guiding slot 35. Furthermore, the overall height H40 of elastic elements 45 attached to base 46 is larger than 0.5 times height 1435 of guiding slot 35. Thus, rotation of each elastic element 45 in guiding slot 35 is avoided, preventing slide 30 from shifting from its natural, initial position after returning.

In this embodiment, each elastic element 45 is a compression spring. At least one force-storing unit 401 is provided between two ends of each elastic element 45. Each force-storing unit 401 is in the form of a metal wire having substantially V-shaped cross sections. Each force-storing unit 401 includes first and second legs 402 and 403 and a compression section 404 between first and second legs 402 and 403. Compression section 404 can store energy when first and second legs 402 and 403 are compressed, providing force-storing unit 401 with an elastic returning function. First leg 402 of each force-storing unit 401 is connected to second leg 403 of an adjacent force-storing unit 401. Thus, compression section 404 of each force-storing unit 401 possesses an elastic returning function.

Base 46 is received in pressing end 352 of guiding slot 35. Two ends of each elastic element 45 respectively abut guide 28 and base 46 for returning slide 30 to the natural, initial position. Two protrusions 461 in the form of cylindrical pegs are formed on a side of base 46 and spaced in the height direction of slide 30. Each protrusion 461 is received in an end of one of elastic elements 45, positioning elastic elements 45 and avoiding operational interference between elastic elements 45 in guiding slot 35.

A rotating face 462 is formed on the other side of base 46 and in sliding contact with pressing end 352 of guiding slot 35. Thus, when base 46 is pressed by elastic elements 45, base 46 can automatically slide and adjust the bending extent of elastic elements 45 in guiding slot 35, avoiding damage to elastic elements 45 resulting from excessive deformation and, thus, prolonging the service life of elastic elements 45.

FIGS. 24-27 show an open end wrench 10 of a sixth embodiment according to the preferred teachings of the present invention that is substantially the same as the fifth embodiment except for elastic device 40.

Two ends of elastic device 40 respectively abut guide 28 and pressing end 352 of guiding slot 35 for returning slide 340 to its natural, initial position. Elastic device 40 is mounted in guiding slot 35 of slide 30 and includes a base 48 and two elastic elements 47 mounted to a side of base 48 and spaced from each other in the height direction of slide 30. An overall height H40 of elastic elements 47 attached to base 48 in the height direction of slide 30 is not larger than height H35 but larger than width W35 of guiding slot 35. Furthermore, the overall height H40 of elastic elements 47 attached to base 48 is larger than 0.5 times height H35 of guiding slot 35. Thus, rotation of each elastic element 47 in guiding slot 35 is avoided, preventing slide 30 from shifting from its natural, initial position after returning.

In this embodiment, each elastic element 47 is a compression spring. At least one force-storing unit 401 is provided between two ends of each elastic element 47. Each force-storing unit 401 is in the form of a metal wire having substantially V-shaped cross sections. Each force-storing unit 401 includes first and second legs 402 and 403 and a compression section 404 between first and second legs 402 and 403. Compression section 404 can store energy when first and second legs 402 and 403 are compressed, providing force-storing unit 401 with an elastic returning function. First leg 402 of each force-storing unit 401 is connected to second leg 403 of an adjacent force-storing unit 401. Thus, compression section 404 of each force-storing unit 401 possesses an elastic returning function.

Base 48 is received in pressing end 352 of guiding slot 35. Two ends of each elastic element 47 respectively abut guide 28 and base 48 for returning slide 30 to the natural, initial position. Two spaced positioning holes 481 are formed on a side of base 48 and spaced in the height direction of slide 30. Each positioning hole 481 receives an end of one of elastic elements 47, positioning elastic elements 47 and avoiding operational interference between elastic elements 47 in guiding slot 35.

A rotating face 482 is formed on the other side of base 48 and in sliding contact with pressing end 352 of guiding slot 35. Thus, when base 48 is pressed by elastic elements 47, base 48 can automatically slide and adjust the bending extent of elastic elements 47 in guiding slot 35, avoiding damage to elastic elements 47 resulting from excessive deformation and, thus, prolonging the service life of elastic elements 47.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. An open end wrench capable of fast driving a workpiece, with the workpiece including first, second, third, fourth, fifth, and sixth sides respectively having first, second, third, fourth, fifth, and sixth faces in a first rotating direction and respectively having first, second, third, fourth, fifth, and sixth force-receiving faces in a second rotating direction, with the open end wrench comprising, in combination:

a body including a handle and a jaw portion formed on an end of the handle, with spaced first and second jaws formed on an end of the jaw portion opposite to the handle, with the jaw portion including a throat intermediate the first and second jaws, with the throat and the first and second jaws together defining a wrenching space adapted for receiving the workpiece, with the first jaw including a force-applying face facing the wrenching space and facing a distal end of the second law, with the force-applying face adapted to correspond to the first force-receiving face in the first rotating direction of the workpiece, with the jaw portion further including an arcuate sliding groove facing the wrenching space, with the sliding groove including spaced, first and second support walls and an arcuate sliding wall extending between the first and second support walls, with the sliding wall being free of holes, grooves, and recesses and having an arcuate face, with a guide provided in the sliding groove and having two ends fixed to the first and second support walls;

a slide slideably received in the sliding groove, with the slide including a first side having an arcuate sliding face slideable along the sliding wall of the sliding groove, with the sliding face being free of holes, grooves, and recesses, with the slide further including a second side opposite to the first side of the slide, with the second side of the slide including a first wrenching face located outside of the sliding groove, with the first wrenching face adapted to correspond to the fourth force-receiving face in the first rotating direction of the workpiece, with the slide further including a top face and a bottom face, with the slide further including a second wrenching face at an angle of 120° to the first wrenching face, with the second wrenching face adapted to correspond to the third force-receiving face in the first rotating direction of the workpiece, with the slide further including an arcuate guiding slot extending from the top face through the bottom face, with the guiding slot free of holes, grooves, and recesses, with the guide received in the guiding slot, preventing the slide from disengaging from the sliding groove, with the guiding slot including an abutting end and a pressing end, with the abutting end being in contact with the guide when the slide is in an initial position not engaged with the workpiece; and an elastic device having two ends respectively abutting the guide and the pressing end of the guiding slot for biasing the slide to the initial position.

2. The open end wrench as claimed in claim 1, with the slide further including an evasive portion between the first and second wrenching faces, with the evasive portion of the slide adapted to allow entrance of the third force-receiving face in the second rotating direction of the workpiece.

3. The open end wrench as claimed in claim 1, with the sliding face of the slide having a first curvature, with the sliding wall of the sliding groove having a second curvature equal to the first curvature, with the sliding face of the slide smoothly slideable along the sliding wall of the sliding groove, with the sliding face adapted to transmit reactive force from the workpiece to the sliding wall and to avoid concentration of stress on the slide, increasing torque bearing capacity of the slide when the workpiece is driven by the body to rotate.

4. The open end wrench as claimed in claim 3, with the guiding slot being arcuate in cross section and having two opposite lateral sides each curved with a curvature equal to the second curvature, allowing relative smooth, arcuate sliding between the guiding groove of the slide and the guide in the sliding groove without operational interference therebetween.

5. The open end wrench as claimed in claim 1, with the top face of the slide in sliding contact with the first support wall of the sliding groove, with the bottom face of the slide in sliding contact with the second support wall of the sliding groove, with the top and bottom faces symmetrically supported by the first and second support walls, avoiding wobbling of the slide while the slide is sliding in the sliding groove and increasing operational stability of the open end wrench.

6. The open end wrench as claimed in claim 1, with the first and second jaws and the jaw portion integrally formed as a single and inseparable component of a same material.

7. An open end wrench capable of fast driving a workpiece, with the workpiece including first, second, third, fourth, fifth, and sixth sides respectively having first, second, third, fourth, fifth, and sixth faces in a first rotating direction and respectively having first, second, third, fourth, fifth, and sixth force-receiving faces in a second rotating direction, with the open end wrench comprising, in combination:

a body including a handle and a jaw portion formed on an end of the handle, with spaced first and second jaws formed on an end of the jaw portion opposite to the handle, with the jaw portion including a throat intermediate the first and second jaws, with the throat and the first and second jaws together defining a wrenching space adapted for receiving the workpiece, with the first jaw including a force-applying face facing the wrenching space and facing a distal end of the second jaw, with the force-applying face adapted to correspond to the first force-receiving face in the first rotating direction of the workpiece, with the throat including a push face facing the wrenching space, with the push face at an angle of 120° to the force-applying face of the first jaw, with the push face of the throat adapted to correspond to the second force-receiving face in the first rotating direction of the workpiece, with the jaw portion further including an arcuate sliding groove facing the wrenching space, with the sliding groove including spaced, first and second support walls and an arcuate sliding wall extending between the first and second support walls, with the sliding wall being free of holes, grooves, and recesses and having an arcuate face, with a guide provided in the sliding groove and having two ends fixed to the first and second support walls;

a slide slideably received in the sliding groove, with the slide including a first side having an arcuate sliding face slideable along the sliding wall of the sliding groove, with the sliding face being free of holes, grooves, and recesses, with the slide further including a second side opposite to the first side of the slide, with the second side of the slide including a first wrenching face located outside of the sliding groove, with the first wrenching face adapted to correspond to the fourth force-receiving face in the first rotating direction of the workpiece, with the slide further including a top face and a bottom face, with the slide further including an arcuate guiding slot extending from the top face through the bottom face, with the guiding slot free of holes, grooves, and recesses, with the guide received in the guiding slot, preventing the slide from disengaging from the sliding groove, with the guiding slot including an abutting end and a pressing end, with the abutting end being in contact with the guide when the slide is in an initial position not engaged with the workpiece; and an elastic device having two ends respectively abutting the guide and the pressing end of the guiding slot for biasing the slide to the initial position.

8. The open end wrench as claimed in claim 7, with the second jaw including first and second faces, with the first face of the second jaw facing the wrenching space and the throat, with the second face of the second jaw facing the wrenching space and a distal end of the first jaw, with the first face of the second jaw at an angle of 120° to the second face of the second jaw, with the first and second faces adapted to correspond respectively to the fourth and third force-receiving faces in the first rotating direction of the workpiece, with the first face of the second jaw parallel to the force-applying face of the first jaw, with a first evasive portion formed between the force-applying face of the first jaw and the push face of the throat, with the first evasive portion adapted to allow entrance of the first force-receiving face in the second rotating direction of the workpiece, with a second evasive portion formed between the push face of the throat and the second face of the second jaw, with the first evasive portion adapted to allow entrance of the second force-receiving face in the second rotating direction of the workpiece, with the jaw portion further including a third evasive portion between the first and second faces of the second jaw, with the third evasive portion adapted to allow entrance of the third force-receiving face in the second rotating direction of the workpiece.

9. An open end wrench capable of fast driving a workpiece, with the workpiece including first, second, third, fourth, fifth, and sixth sides respectively having first, second, third, fourth, fifth, and sixth faces in a first rotating direction and respectively having first, second, third, fourth, fifth, and sixth force-receiving faces in a second rotating direction, with the open end wrench comprising, in combination:

a body including a handle and a jaw portion formed on an end of the handle, with spaced first and second jaws formed on an end of the jaw portion opposite to the handle, with the jaw portion including a throat intermediate the first and second jaws, with the throat and the first and second jaws together defining a wrenching space adapted for receiving the workpiece, with the first jaw including a force-applying face facing the wrenching space and facing a distal end of the second jaw, with the force-applying face adapted to correspond to the first force-receiving face in the first rotating direction of the workpiece, with the jaw portion further including an arcuate sliding groove facing the wrenching space, with the sliding groove including spaced, first and second support walls and an arcuate sliding wall extending between the first and second support walls, with the sliding wall being free of holes, grooves, and recesses and having an arcuate face, with a guide provided in the sliding groove and having two ends fixed to the first and second support walls;

a slide slideably received in the sliding groove, with the slide including a first side having an arcuate sliding face slideable along the sliding wall of the sliding groove, with the sliding face being free of holes, grooves, and recesses, with the slide further including a second side opposite to the first side of the slide, with the second side of the slide including a first wrenching face located outside of the sliding groove, with the first wrenching face adapted to correspond to the fourth force-receiving face in the first rotating direction of the workpiece, with the slide further including a top face and a bottom face, with the slide further including an arcuate guiding slot extending from the top face through the bottom face, with the guiding slot free of holes, grooves, and recesses, with the guide received in the guiding slot, preventing the slide from disengaging from the sliding groove, with the guiding slot including an abutting end and a pressing end, with the abutting end being in contact with the guide when the slide is in an initial position not engaged with the workpiece; and an elastic device having two ends respectively abutting the guide and the pressing end of the guiding slot for biasing the slide to the initial position, with the elastic device including an elastic element received in the guiding slot of the slide, with the first and second support walls of the sliding groove parallel to each other and having a spacing therebetween, with the top and bottom faces of the slide parallel to each other and having a height in a height direction of the slide equal to the spacing, with the guiding slot of the slide having a height in the height direction of the slide equal to the height of the slide, with the guiding slot having a width in a width direction perpendicular to the height direction of the guiding slot, with the width of the guiding slot equal to a diameter of the guide, with the height of the guiding slot larger than 1.5 times the width of the guiding slot, with the elastic element received in the guiding slot having a height in the height direction of the slide not larger than the height of the guiding slot, with the height of the elastic element larger than the width of the guiding slot, with the height of the elastic element larger than 0.5 times the height of the guiding slot.

10. The open end wrench as claimed in claim 9, with the elastic element being a resilient plate having first and second ends and having Z-shaped cross sections, with a plurality of force-storing units provided between the first and second ends of the elastic element, with each of the plurality of force-storing units being a metal plate having substantially V-shaped cross sections, with each of the plurality of force-storing units including first and second legs and a compression section between the first and second legs, with the compression section storing energy when the first and second legs are compressed, providing the force-storing unit with an elastic returning function, with the first leg of each of the plurality of force-storing units connected to the second leg of an adjacent one of the plurality of force-storing units, wherein the compression section of each of the plurality of force-storing units possesses the elastic returning function, with the first leg on the first end of the elastic element abutting the guide, and with the second leg on the second end of the elastic element abutting the pressing end of the guiding slot.

11. The open end wrench as claimed in claim 9, with the elastic element being a compression spring having first and second ends and having Z-shaped cross sections, with a plurality of force-storing units provided between the first and second ends of the elastic element, with each of the plurality of force-storing units being a metal wire having substantially V-shaped cross sections, with each of the plurality of force-storing units including first and second legs and a compression section between the first and second legs, with the compression section storing energy when the first and second legs are compressed, providing the force-storing unit with an elastic returning function, with the first leg of each of the plurality of force-storing units connected to the second leg of an adjacent one of the plurality of force-storing units, wherein the compression section of each of the plurality of force-storing units possesses the elastic returning function, with the first leg on the first end of the elastic element abutting the guide, with the second leg on the second end of the elastic element abutting the pressing end of guiding slot.

12. The open end wrench as claimed in claim 9, with the elastic element being a torsion spring having a first connection unit and a force-storing unit, with the force-storing unit being a metal wire having substantially V-shaped cross sections, with the force-storing unit including first and second legs and a compression section between the first and second legs, with the compression section storing energy when the first and second legs are compressed, providing the force-storing unit with an elastic returning function, with the first leg of the force-storing unit connected to the first connection unit, with the first connection unit of the elastic element abutting the guide.

13. The open end wrench as claimed in claim 12, with the elastic element further including a second connection unit opposite to the first connection unit, with the second leg of the force-storing unit connected to the second connection unit, with the second connection unit abutting the pressing end of the guiding slot.

14. The open end wrench as claimed in claim 9, with the elastic element being a compression spring having upper and lower sections interconnected by a connecting section with a spacing formed between the upper and lower sections spaced in the height direction of the slide, with each of the upper and lower section of the elastic element having first and second ends, with a plurality of force-storing units provided between the first and second ends of each of the upper and lower sections of the elastic element, with each of the plurality of the force-storing units being a metal wire having substantially V-shaped cross sections, with each of the plurality of the force-storing units including first and second legs and a compression section between the first and second legs, with the compression section storing energy when the first and second legs are compressed, providing the force-storing unit with an elastic returning function, with the first leg of each of the plurality of force-storing units connected to the second leg of an adjacent one of the plurality of force-storing units, wherein the compression section of each of the plurality of force-storing units possesses the elastic returning function, with the first leg on the first end of each of the upper and lower sections of the elastic element abutting the guide, with the second legs on the second ends of the upper and lower sections of the elastic element interconnected by the connecting section and abutting the pressing end of the guiding slot, allowing the slide to be returned to its initial position.

15. An open end wrench capable of fast driving a workpiece, with the workpiece including first, second, third, fourth, fifth, and sixth sides respectively having first, second, third, fourth, fifth, and sixth faces in a first rotating direction and respectively having first, second, third, fourth, fifth, and sixth force-receiving faces in a second rotating direction, with the open end wrench comprising, in combination:

a body including a handle and a jaw portion formed on an end of the handle, with spaced first and second jaws formed on an end of the jaw portion opposite to the handle, with the jaw portion including a throat intermediate the first and second jaws, with the throat and the first and second jaws together defining a wrenching space adapted for receiving the workpiece, with the first jaw including a force-applying face facing the wrenching space and facing a distal end of the second jaw, with the force-applying face adapted to correspond to the first force-receiving face in the first rotating direction of the workpiece, with the jaw portion further including an arcuate sliding groove facing the wrenching space, with the sliding groove including spaced, first and second support walls and an arcuate sliding wall extending between the first and second support walls, with the sliding wall being free of holes, grooves, and recesses and having an arcuate face, with a guide provided in the sliding groove and having two ends fixed to the first and second support walls;

a slide slideably received in the sliding groove, with the slide including a first side having an arcuate sliding face slideable along the sliding wall of the sliding groove, with the sliding face being free of holes, grooves, and recesses, with the slide further including a second side opposite to the first side of the slide, with the second side of the slide including a first wrenching face located outside of the sliding groove, with the first wrenching face adapted to correspond to the fourth force-receiving face in the first rotating direction of the workpiece, with the slide further including a top face and a bottom face, with the slide further including an arcuate guiding slot extending from the top face through the bottom face, with the guiding slot free of holes, grooves, and recesses, with the guide received in the guiding slot, preventing the slide from disengaging from the sliding groove, with the guiding slot including an abutting end and a pressing end, with the abutting end being in contact with the guide when the slide is in an initial position not engaged with the workpiece; and an elastic device having two ends respectively abutting the guide and the pressing end of the guiding slot for biasing the slide to the initial position, with the elastic device including a base having a first side and two elastic elements mounted to the first side of the base, with the first and second support walls of the sliding groove parallel to each other and having a spacing therebetween, with the top and bottom faces of the slide parallel to each other and having a height in a height direction of the slide equal to the spacing, with the guiding slot of the slide having a height in the height direction of the slide equal to the height of the slide, with the guiding slot having a width in a width direction perpendicular to the height direction of the guiding slot, with the width of the guiding slot equal to a diameter of the guide, with the height of the guiding slot larger than 1.5 times the width of the guiding slot, with the two elastic elements spaced in the height direction of the slide, with the two elastic elements attached to the base having an overall height in the height direction of the slide not larger than the height of the guiding slot, with the overall height of the two elastic elements larger than the width of the guiding slot, with the overall height of the two elastic elements larger than 0.5 times the height of the guiding slot.

16. The open end wrench as claimed in claim 15, with each of the two elastic elements being a compression spring having first and second ends, with a plurality of force-storing units provided between the first and second ends of each of the two elastic elements, with each of the plurality of force-storing units being a metal wire having substantially V-shaped cross sections, with each of the plurality of force-storing units including first and second legs and a compression section between the first and second legs, with the compression section storing energy when the first and second legs are compressed, providing the force-storing unit with an elastic returning function, with the first leg of each of the plurality of force-storing units connected to the second leg of an adjacent one of the plurality of force-storing units, wherein the compression section of each of the plurality of force-storing units possesses the elastic returning function, with the base received in the pressing end of the guiding slot, with the first and second ends of each of the two elastic elements respectively abutting the guide and the base for returning the slide to the initial position.

17. The open end wrench as claimed in claim 16, with the first side of the base including two protrusions pegs spaced in the height direction of the slide, with each of the protrusions received in an end of one of the two elastic elements, positioning the two elastic elements and avoiding operational interference between the two elastic elements in the guiding slot, with the base further including a second side having a rotating face in sliding contact with the pressing end of the guiding slot.

18. The open end wrench as claimed in claim 16 with the first side of the base including two positioning holes spaced in the height direction of the slide, with each of the two positioning holes receiving an end of one of the two elastic elements, positioning the two elastic elements and avoiding operational interference between the two elastic elements in the guiding slot, with the base further including a second side having a rotating face in sliding contact with the pressing end of the guiding slot.

* * * * *